US008985221B2

(12) United States Patent
Mazzanti

(10) Patent No.: US 8,985,221 B2
(45) Date of Patent: Mar. 24, 2015

(54) SYSTEM AND METHOD FOR PRODUCTION OF RESERVOIR FLUIDS

(75) Inventor: Daryl V. Mazzanti, Spring, TX (US)

(73) Assignee: NGSIP, LLC, Houston, TX (US)

( * ) Notice: Subject to any disclaimer, the term of this patent is extended or adjusted under 35 U.S.C. 154(b) by 742 days.

(21) Appl. No.: 13/190,078

(22) Filed: Jul. 25, 2011

(65) Prior Publication Data

US 2011/0278015 A1 Nov. 17, 2011

Related U.S. Application Data

(63) Continuation-in-part of application No. 12/001,152, filed on Dec. 10, 2007, now Pat. No. 8,006,756.

(51) Int. Cl.

| | |
|---|---|
| ***E21B 43/00*** | (2006.01) |
| ***E21B 17/18*** | (2006.01) |
| ***E21B 43/12*** | (2006.01) |
| ***E21B 43/30*** | (2006.01) |

(52) U.S. Cl.

CPC ..... *E21B 17/18* (2013.01); *E21B 43/122* (2013.01); *E21B 43/305* (2013.01)

USPC ..... 166/372; 166/106

(58) Field of Classification Search

CPC ..... E21B 43/121; E21B 43/122; E21B 17/18; E21B 43/305

USPC ..... 166/372, 114, 64, 386, 263, 370, 242.3, 166/184, 334.4, 316, 106

See application file for complete search history.

(56) References Cited

U.S. PATENT DOCUMENTS

| | | | | |
|---|---|---|---|---|
| 4,519,457 | A * | 5/1985 | Holland et al. | 166/317 |
| RE35,454 | E * | 2/1997 | Cobb | 166/265 |
| 6,079,491 | A * | 6/2000 | Stuebinger et al. | 166/266 |
| 2009/0145595 | A1 * | 6/2009 | Mazzanti | 166/106 |
| 2009/0194293 | A1 * | 8/2009 | Stephenson et al. | 166/372 |

OTHER PUBLICATIONS

Weatherford International, Ltd., Weatherford T-2 On-Off Tool, 2009.*

* cited by examiner

*Primary Examiner* — Jennifer H Gay
*Assistant Examiner* — George Gray
(74) *Attorney, Agent, or Firm* — Strasburger & Price, LLP

(57) ABSTRACT

A system and method for lifting reservoir fluids from reservoir to surface through a wellbore having a first tubing string extending through a packer in a wellbore casing. The system includes a bi-flow connector in the first tubing string, a second tubing string in the first tubing string below the bi-flow connector, and a third tubing string in the first tubing string above and connected with the bi-flow connector. A fluid displacement device in the third tubing string is configured to move reservoir fluids to the surface. The first tubing string allows pressured gas to move from the surface through the bi-flow connector to commingle with and lift reservoir fluids through annuli defined by the first and second tubing strings and defined by the casing and the first tubing string. The bi-flow connector is configured to allow simultaneous and non-contacting flow of the downward pressured gas and lifted reservoir fluid.

23 Claims, 20 Drawing Sheets

SYSTEM AND METHOD FOR PRODUCTION OF RESERVOIR FLUIDS

CROSS-REFERENCE TO RELATED APPLICATIONS

This application is a continuation-in-part of co-pending U.S. application Ser. No. 12/001,152 filed on Dec. 10, 2007, which application is hereby incorporated by reference for all purposes in its entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to production systems and methods deployed in subterranean oil and gas wells.

2. Description of the Related Art

Many oil and gas wells will experience liquid loading at some point in their productive lives due to the reservoir's inability to provide sufficient energy to carry wellbore liquids to the surface. The liquids that accumulate in the wellbore may cause the well to cease flowing or flow at a reduced rate. To increase or re-establish the production, operators place the well on artificial lift, which is defined as a method of removing wellbore liquids to the surface by applying a form of energy into the wellbore. Currently, the most common artificial lift systems in the oil and gas' industry are down-hole pumping systems, plunger lift systems, and compressed gas systems.

The most popular form of down-hole pump is the sucker rod pump. It comprises a dual ball and seat assembly, and a pump barrel containing a plunger. A string of sucker rods connects the downhole pump to a pump jack at the surface. The pump jack at the surface provides the reciprocating motion to the rods which in turn provides the reciprocal motion to stroke the pump, which is a fluid displacement device. As the pump strokes, fluids above the pump are gravity fed into the pump chamber and are then pumped up the production tubing and out of the wellbore to the surface facilities. Other downhole pump systems include progressive cavity, jet, electric submersible pumps and others.

A plunger lift system utilizes compressed gas to lift a free piston traveling from the bottom of the tubing in the wellbore to the surface. Most plunger lift systems utilize the energy from a reservoir by closing in the well periodically in order to build up pressure in the wellbore. The well is then opened rapidly which creates a pressure differential, and as the plunger travels to the surface, it lifts reservoir liquids that have accumulated above the plunger. Like the pump, the plunger is also a fluid displacement device.

Compressed gas systems can be either continuous or intermittent. As their names imply, continuous systems continuously inject gas into the wellbore and intermittent systems inject gas intermittently. In both systems, compressed gas flows into the casing-tubing annulus of the well and travels down the wellbore to a gas lift valve contained in the tubing string. If the gas pressure in the casing-tubing annulus is sufficiently high compared to the pressure inside the tubing adjacent to the valve, the gas lift valve will be in the open position which subsequently allows gas in the casing-tubing annulus to enter the tubing and thus lift liquids in the tubing out of the wellbore. Continuous gas lift systems work effectively unless the reservoir has a depletion or partial depletion drive, which results in a pressure decline in the reservoir as fluids are removed. When the reservoir pressure depletes to a point that the gas lift pressure causes significant back pressure on the reservoir, continuous gas lift systems become inefficient and the flow rate from the well is reduced until it is uneconomic to operate the system. Intermittent gas lift systems apply this back pressure intermittently and therefore can operate economically for longer periods of time than continuous systems. Intermittent systems are not as common as continuous systems because of the difficulties and expense of operating surface equipment on an intermittent basis.

Horizontal drilling was developed to access irregular fossil energy deposits in order to enhance the recovery of hydrocarbons. Directional drilling was developed to access fossil energy deposits some distance from the surface location of the wellbore. Generally, both of these drilling methods begin with a vertical hole or well. At a certain point in this vertical well, a turn of the drilling tool is initiated which eventually brings the drilling tool into a deviated position with respect to the vertical position.

It is not practical to install most artificial lift systems in the deviated sections of directional or horizontal wells or deep into the perforated section of vertical wells since down-hole equipment installed in these regions may be inefficient or can undergo high maintenance costs due to wear and/or solids and gas entrained in the liquids interfering with the operation of the pump. Therefore, most operators only install down-hole artificial lift equipment in the vertical portion of the wellbore above the reservoir. In many vertical wells with relatively long perforated intervals, many operators choose to not install artificial lift equipment in the well due to the factors above. Downhole pump systems, plunger lift systems, and compressed gas lift systems are not designed to recover any liquids that exist below the downhole equipment. Therefore, in many vertical, directional, and horizontal wells, a column of liquid ranging from hundreds to many thousands of feet may exist below the down-hole artificial lift equipment. Because of the limitations with current artificial lift systems, considerable hydrocarbon reserves cannot be recovered using conventional methods in depletion or partial depletion drive directional or horizontally drilled wells, and vertical wells with relatively long perforated intervals. Thus, a major problem with the current technology is that reservoir liquids located below conventional down-hole artificial lift equipment cannot be lifted.

There is a need to provide an artificial lift system that will enable the recovery of liquids in the deviated sections of directional or horizontal wellbores, and in vertical wells with relatively long perforated intervals.

There is a need to provide an artificial lift system that will enable the recovery of liquids in vertical wells with relatively long perforated intervals and in the deviated sections of directional and horizontal wellbores with smaller casing diameters.

There is a need to lower the artificial lift point in vertical wells with relatively long perforated intervals and in wells with deviated or horizontal sections.

There is a need to provide a high velocity volume of injection gas to more efficiently sweep the reservoir liquids from the wellbore.

There is a need to provide a more efficient, less costly wellbore liquid removal process.

There is a need for a less costly artificial lift method for vertical wells with relatively long perforated intervals and for wells with deviated or horizontal sections.

There is a need for a less costly and more efficient artificial lift method for wells that still have sufficient reservoir energy and reservoir gas to lift liquids from below to above the downhole artificial lift equipment.

Finally, there is a need to provide a more efficient gas and solid separation method to lower the lift point in wells with deviated and horizontal sections and for vertical wells with relatively long perforated intervals.

BRIEF SUMMARY OF THE INVENTION

A gas assisted downhole system is disclosed, which is an artificial lift system designed to recover by-passed hydrocarbons in directional, vertical and horizontal wellbores by incorporating a dual tubing arrangement. In one embodiment, a first tubing string contains a gas lift system, and a second tubing string contains a downhole pumping system. In the first tubing string, the gas lift system, which is preferably intermittent, is utilized to lift reservoir fluids from below the downhole pump to above a packer assembly where the fluids become trapped. As more reservoir fluids are added above the packer, the fluid level rises in the casing annulus above the downhole pump installed in the adjacent second tubing string, and the trapped reservoir fluids are pumped to the surface by the downhole pump. In another embodiment, the second tubing string contains a downhole plunger system. As reservoir fluids are added above the packer, the fluid level rises in the casing annulus above the downhole plunger installed in the adjacent second tubing string, and the trapped reservoir fluids are lifted to the surface by the downhole plunger system.

A dual string anchor may be disposed with the first tubing string to limit the movement of the second tubing string. The second tubing string may be removably attached with the dual string anchor with an on-off tool without disturbing the first tubing string. A one-way valve may also be used to allow reservoir fluids to flow into the first tubing string in one direction only. The one way valve may be placed in the first tubing string below the packer to allow trapped pressure below the packer to be released into the first tubing string. The valve provides a pathway to the surface for the gas trapped below the packer. The resulting reduced back pressure on the reservoir may lead to production increases.

In another embodiment, the second tubing string may be within the first tubing string, and the injected gas may travel down the annulus between the first and second tubing strings. The second string may house a fluid displacement device, such as a downhole pumping system or a plunger lift system. A bi-flow connector may anchor the second string to the first string and allow reservoir liquids in the casing tubing annulus to pass through the anchor to the downhole pump. In one embodiment, the bi-flow connector may be a cylindrical body having a thickness, a first end, a second end, a central bore from the first end to said second end, and a side surface. A first channel may be disposed through the thickness from the first end to the second end. A second channel may be disposed through the thickness from the side surface to the central bore, with the first channel and second channel not intersecting. Injected gas may be allowed to pass vertically through the bi-flow connector to lift liquids from below the downhole pump to above the downhole pump. The bi-flow connector prevents the injected gas from contacting the reservoir liquids flowing through the bi-flow connector. Also contemplated are multiple channels in addition to the first channel and multiple channels in addition to the second channel.

In yet another embodiment, gas from the reservoir lifts reservoir liquids from below the fluid displacement device, such as a downhole pump or a plunger, to above the fluid displacement device. A first tubing string may contain the fluid displacement device above a packer assembly. A blank sub may be positioned between an upper perforated sub and a lower perforated sub in the first tubing string below the fluid displacement device. A second tubing string within the first tubing string and located below the lower perforated sub may lifts liquids using the gas from the reservoir.

BRIEF DESCRIPTION OF THE DRAWINGS

For a further understanding of the nature and objects of the present invention, reference is had to the following figures in which like parts are given like reference numerals and wherein.

DETAILED DESCRIPTION OF THE INVENTION

Figure 1:
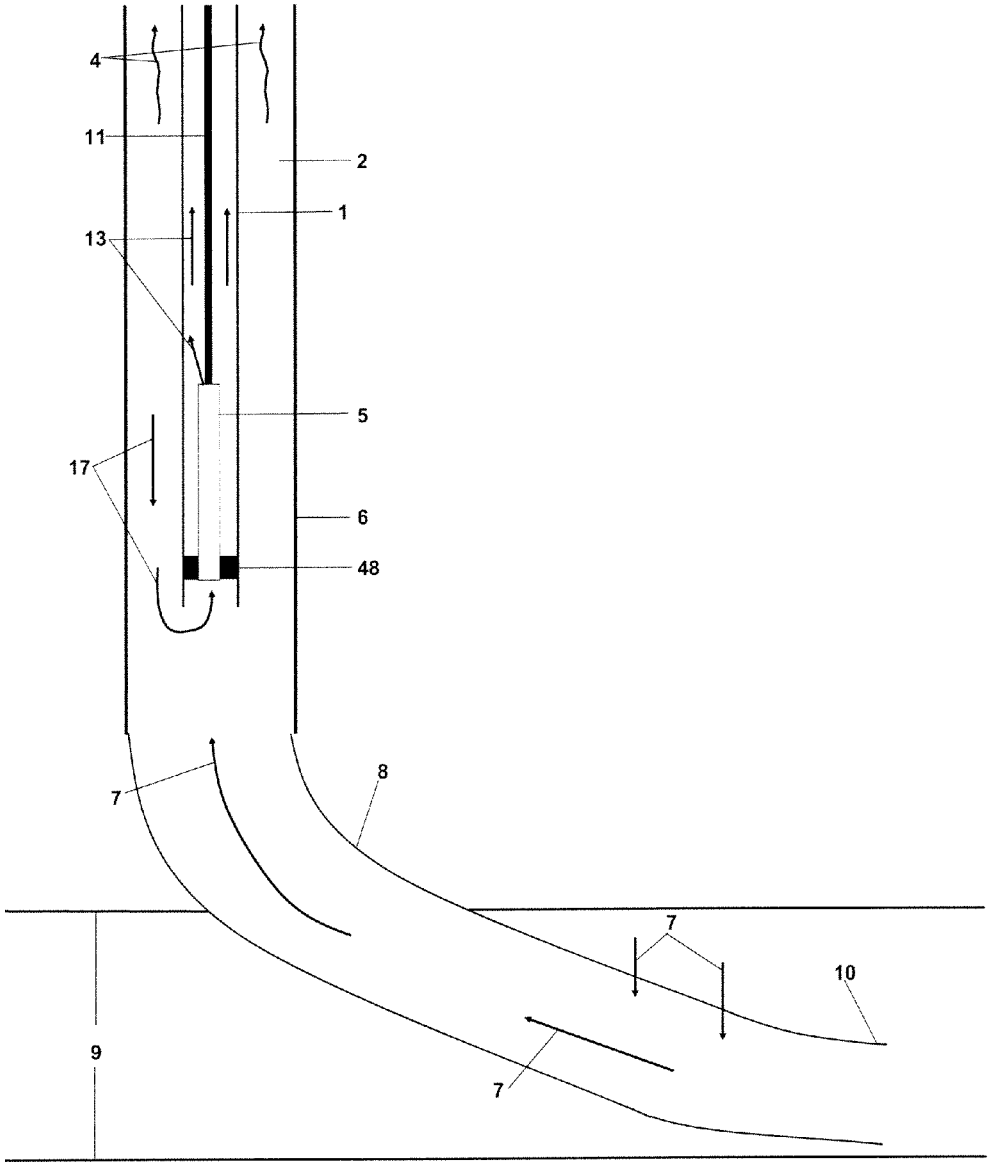
FIG. 1 depicts a directional or horizontal wellbore installed with a conventional rod pumping system of the prior art.

FIG. 1 shows one example of a conventional rod pump system of the prior art in a directional or horizontal wellbore.

As set out in FIG. 1, tubing 1, which contains pumped liquids 13 is mounted inside a casing 6. A pump 5 is connected at the end of tubing 1 in a seating nipple 48 nearest the reservoir 9. Sucker rods 11 are connected from the top of pump 5 and continue vertically to the surface 12. Casing 6, cylindrical in shape, surrounds and may be coaxial with tubing 1 and extends below tubing 1 and pump 5 on one end and extends vertically to surface 12 on the other end. Below casing 6 is curve 8 and lateral 10 which is drilled through reservoir 9.

The process is as follows: reservoir fluids 7 are produced from reservoir 9 and enter lateral 10, rise up curve 8 and casing 6. Because reservoir fluids 7 are usually multiphase, they separate into annular gas 4 and liquids 17. Annular gas 4 separates from reservoir fluids 7 and rises in annulus 2, which is the void space formed between tubing 1 and casing 6. The annular gas 4 continues to rise up annulus 2 and then flows out of the well to the surface 12. Liquids 17 enter pump 5 by the force of gravity from the weight of liquids 17 above pump 5 and enter pump 5 to become pumped liquids 13 which travel up tubing 1 to the surface 12. Pump 5 is not considered to be limiting, but may be any down-hole pump or pumping system, such as a progressive cavity, jet pump, or electric submersible, and the like.

Figure 2:
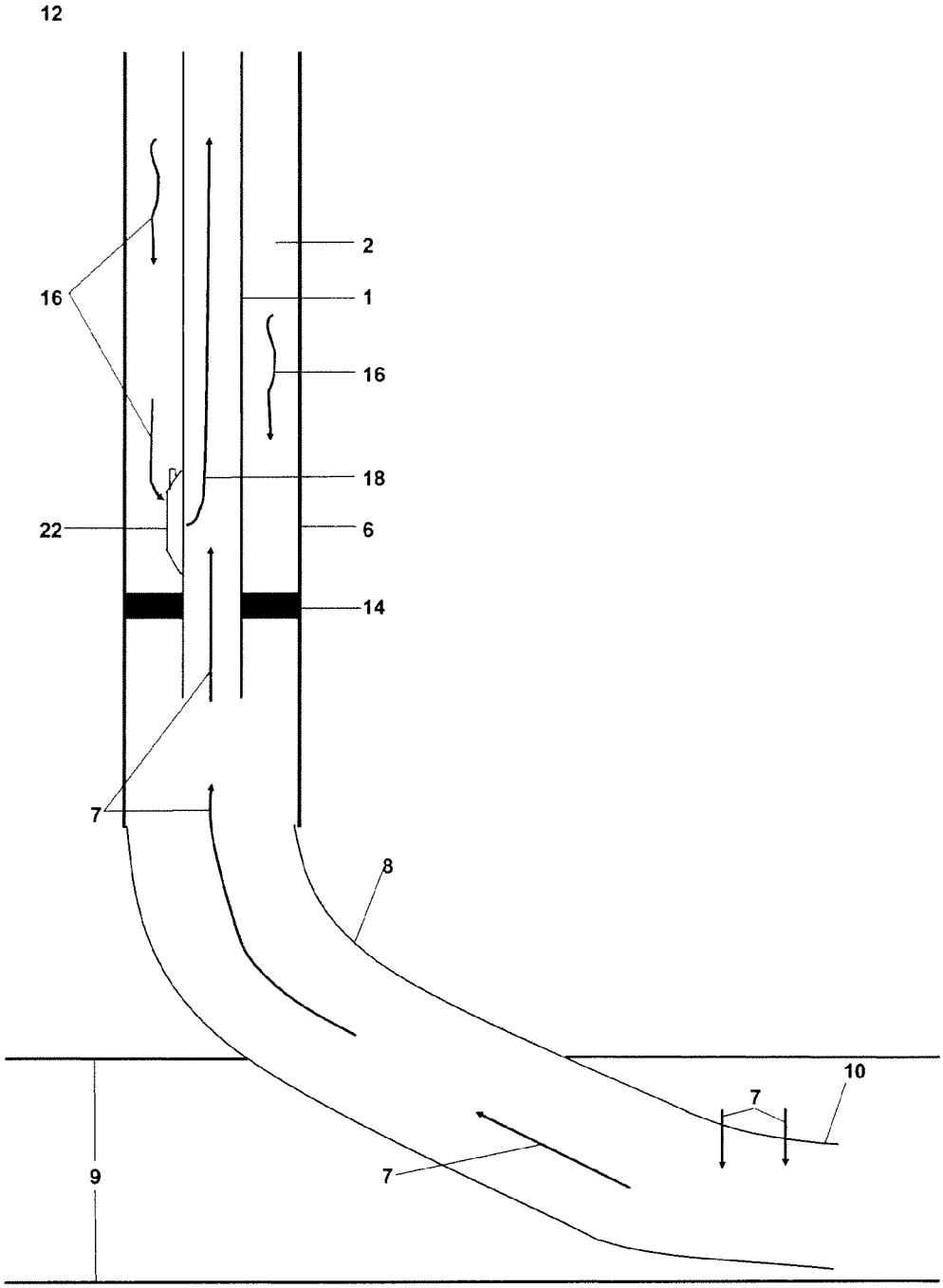
FIG. 2 depicts a conventional gas lift system in a directional or horizontal wellbore of the prior art.

FIG. 2 shows one example of a conventional gas lift system of the prior art in a directional or horizontal wellbore. Referring to FIG. 2, inside the casing 6, is tubing 1 connected to packer 14 and conventional gas lift valve 22. Below casing 6 is curve 8 and lateral 10 which is drilled through reservoir 9. The process is as follows: reservoir fluids 7 from reservoir 9 enter lateral 10 and rise up curve 8 and casing 6 and enter tubing 1. The packer 14 provides pressure isolation which allows annulus 2, which is formed by the void space between casing 6 and tubing 1, to increase in pressure from the injection of injection gas 16. Once the pressure increases sufficiently in annulus 2, conventional gas lift valve 22 opens and allows injection gas 16 to pass from annulus 2 into tubing 1, which then commingles with reservoir fluids 7 to become commingled fluids 18. This lightens the fluid column and commingled fluids 18 rise up tubing 1 and then flow out of the well to surface 12.

Figure 3:
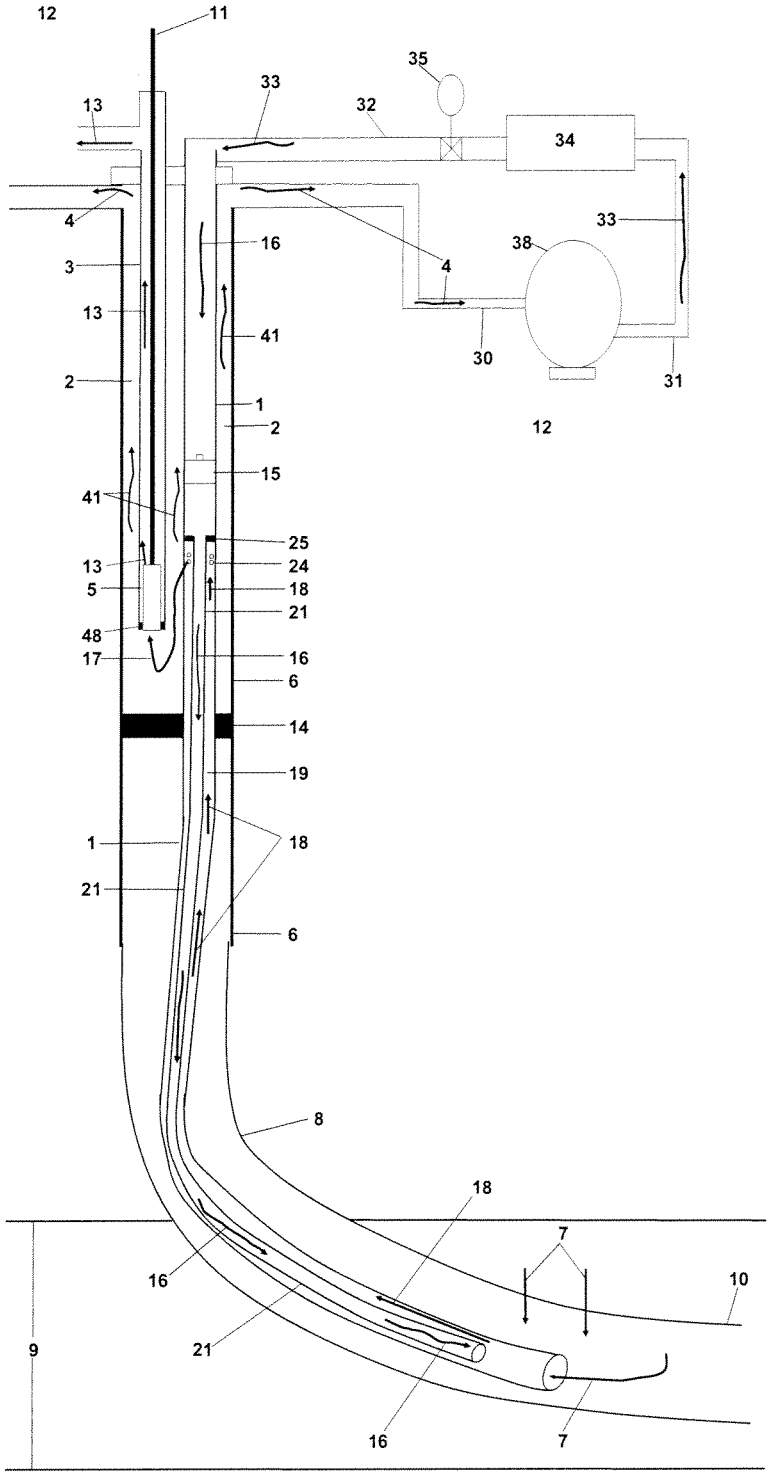
FIG. 3 depicts an embodiment of the invention utilizing a rod pump and a gas lift system.

FIG. 3 shows an embodiment utilizing a downhole pump and a gas lift system in a horizontal or deviated wellbore. Referring to FIG. 3, inside casing 6, is tubing 1 which begins at surface 12 and contains internal gas lift valve 15, bushing 25, and inner tubing 21. Inner tubing 21 may be within tubing 1, such as concentric. Bushing 25 may be a section of pipe whose purpose is to threadingly connect pipe joints using both its outer diameter and its inner diameter. Bushing 25 may have pipe threads at one or both ends of its outer diameter, and pipe threads at one or both ends of its inner diameter. Other types of bushings and connection means are also contemplated. Tubing 1 is sealingly engaged to packer 14. Tubing 1 and inner tubing 21 extend below packer 14 through curve 8 and into lateral 10, which is drilled through reservoir 9. Inside casing 6 and adjacent to tubing 1 is tubing 3, which contains sucker rods 11 connected to pump 5. Pump 5 is connected to the end of tubing 3 by seating nipple 48. Tubing 3 is not sealingly engaged to packer 14.

The process may be as follows: reservoir fluids 7 enter lateral 10 and enter tubing 1. The reservoir fluids 7 are commingled with injection gas 16 to become commingled fluids 18 which rise up chamber annulus 19, which is the void space formed between inner tubing 21 and tubing 1. The commingled fluids 18 then exit through the holes in perforated sub 24. Commingled gas 41 separates from commingled fluids 18 and rises in annulus 2, which is formed by the void space between casing 6 and tubing 1 and tubing 3. Commingled gas 41 then enters flow line 30 at the surface 12 and enters compressor 38 to become compressed gas 33, and travels through flow line 31 to surface tank 34. The compressor 38 is not considered to be limiting, in that it is not crucial to the design if another source of pressured gas is available, such as pressured gas from a pipeline.

Compressed gas 33 then travels through flow line 32 which is connected to actuated valve 35. This actuated valve 35 opens and closes depending on either time or pressure realized in surface tank 34. When actuated, valve 35 opens, compressed gas 33 flows through actuated valve 35 and travels through flow line 32 and into tubing 1 to become injection gas 16. The injection gas 16 travels down tubing 1 to internal gas lift valve 15, which is normally closed thereby preventing the flow of injection gas 16 down tubing 1. A sufficiently high pressure in tubing 1 above internal gas lift valve 15 opens internal gas lift valve 15 and allows the passage of injection gas 16 through internal gas lift valve 15. The injection gas 16 then enters the inner tubing 21, and eventually commingles with reservoir fluids 7 to become commingled fluids 18, and the process begins again. Liquids 17 and commingled gas 41 separate from the commingled fluids 18 and liquids 17 fall in annulus 2 and are trapped above packer 14. Commingled gas 41 rises up annulus 2 as previously described. As more liquids 17 are added to annulus 2, liquids 17 rise above and are gravity fed into pump 5 to become pumped liquids 13 which travel up tubing 3 to surface 12.

Figure 4:
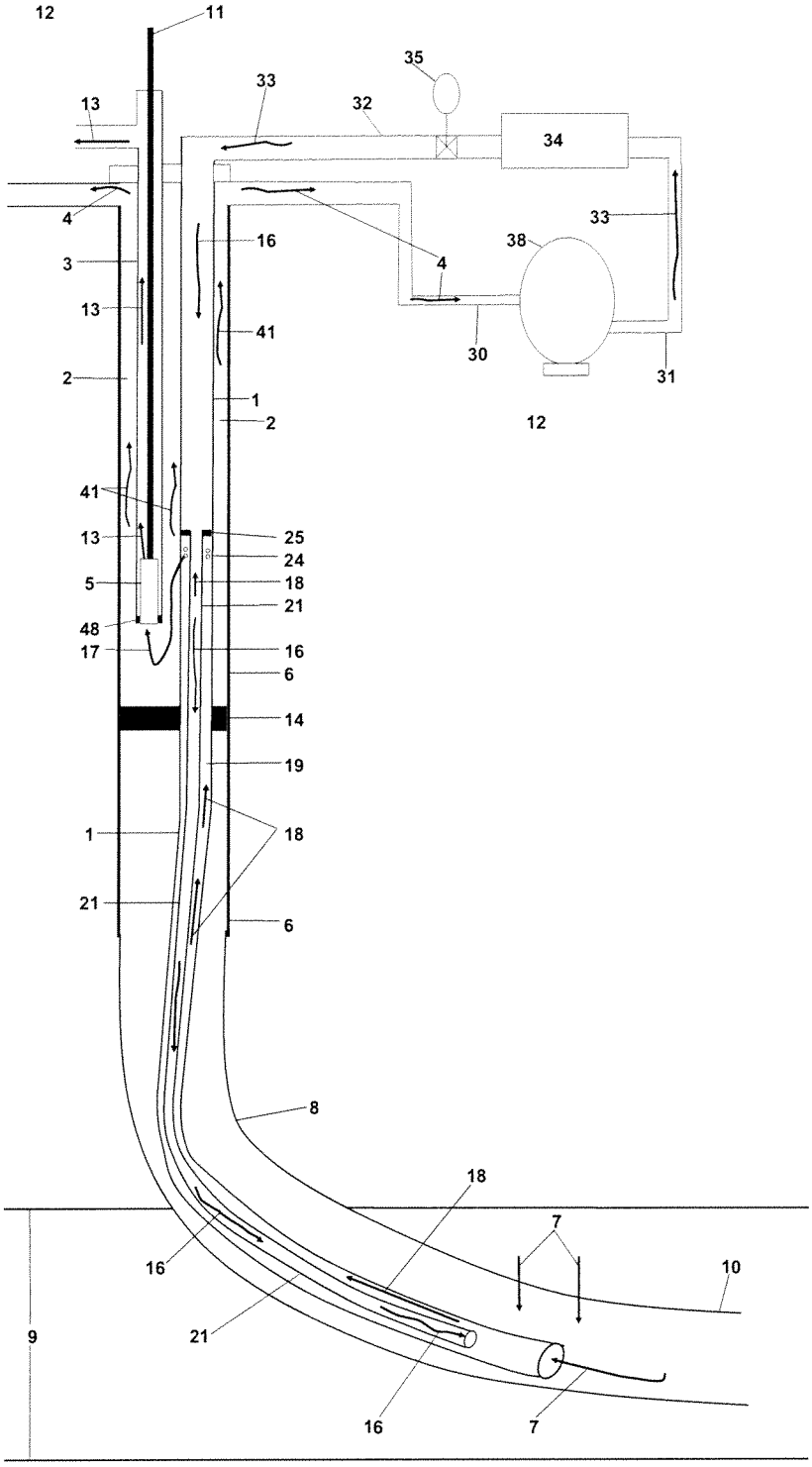
FIG. 4 depicts another embodiment of the invention similar to FIG. 3 except with no internal gas lift valve.

FIG. 4 shows an alternate embodiment similar to the design in FIG. 3 except that it does not utilize the internal gas lift valve 15.

Figure 5:
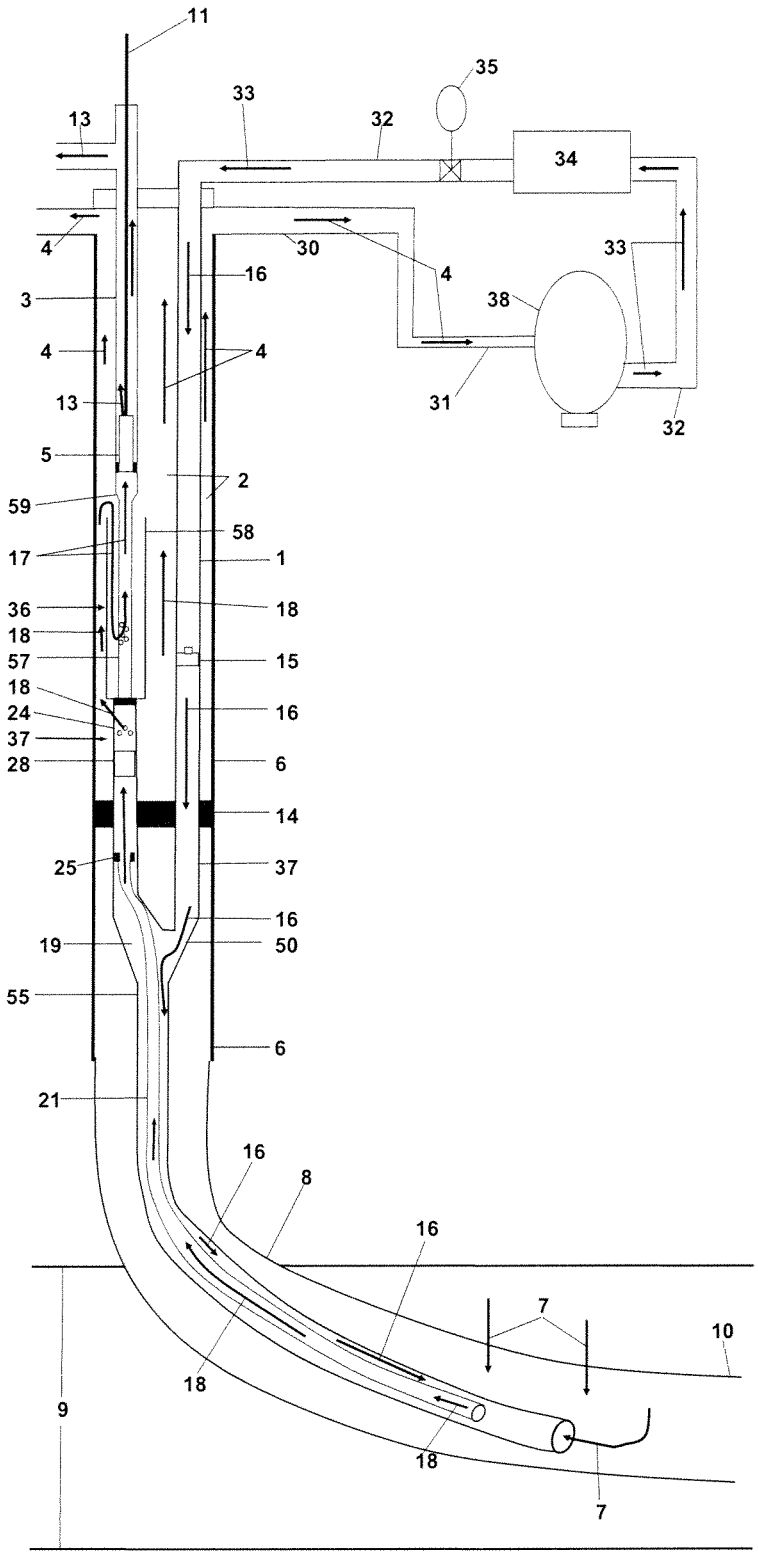
FIG. 5 depicts yet another embodiment of the invention having a Y block.

FIG. 5 shows yet another alternate embodiment utilizing a downhole pump and a gas lift system in a horizontal or deviated wellbore with a different downhole configuration from FIG. 3. Referring to FIG. 5, inside the casing 6 is tubing 1 which contains an internal gas lift valve 15 and is sealingly engaged to packer 14. Packer 14 is preferably a dual packer assembly and is connected to Y block 50 which in turn is connected to chamber outer tubing 55. Chamber outer tubing 55 continues below casing 6 through curve 8 and into lateral 10 which is drilled through reservoir 9. Inner tubing 21 is secured by chamber bushing 22 to one of the tubular members of Y Block 50 leading to lower tubing section 37. Inner tubing 21 may be concentric with chamber outer tubing 55. The inner tubing 21 extends inside of Y block 50 and chamber outer tubing 55 through the curve 8 and into the lateral 10. The second tubing string arrangement comprises a lower section 37 and an upper section 36. The lower section 37 comprises a perforated sub 24 connected above a one way valve 28 and is then sealingly engaged in the packer 14.

Perforated sub 24 is closed at its upper end and is connected to the upper tubing section 36. Upper tubing section 36 comprises a gas shroud 58, a perforated inner tubular member 57, a cross over sub 59 and tubing 3 which contains pump 5 and sucker rods 11. The gas shroud 58 is tubular in shape and is closed at its lower end and open at its upper end. It surrounds perforated inner tubular member 57, which extends above gas shroud 58 to crossover sub 59 and connects to the tubing 3, which continues to the surface 12. Above the crossover sub 59, and contained inside of tubing 3 at its lower end, is pump 5 which is connected to sucker rods 11, which continue to the surface 12. Annular gas 4 travels up annulus 2 into flowline 30 which is connected to compressor 38 which compresses annular gas 4 to become compressed gas 33. The compressor 38 is not considered to be limiting, in that it is not crucial to the design if another source of pressured gas is available, such as pressured gas from a pipeline.

Compressed gas 33 flows through flowline 31 to surface tank 34 which is connected to a second flowline 32 that is connected to actuated valve 35. This actuated valve 35 opens and closes depending on either time or pressure realized in surface tank 34. When actuated valve 35 opens, compressed gas 33 flows through actuated valve 35 and travels through flowline 32 and into tubing 1 to become injection gas 16. The injection gas 16 travels down tubing 1 to internal gas lift valve 15, which is normally closed thereby preventing the flow of injection gas 16 down tubing 1. A sufficiently high pressure in tubing 1 above internal gas lift valve 15 opens internal gas lift valve 15 and allows the passage of injection gas 16 through internal gas lift valve 15, through Y Block 50 and into chamber annulus 19, which is the void space between inner concentric tubing 21 and chamber outer tubing 55. Injection gas 16 is forced to flow down chamber annulus 19 since its upper end is isolated by chamber bushing 25. Injection gas 16 displaces the reservoir fluids 7 to become commingled fluids 18 which travel up the inner concentric tubing 21.

Commingled fluids 18 travel out of inner concentric tubing 21 into one of the tubular members of Y Block 50, through packer 14 and standing valve 28, and then through the perforated sub 24 into annulus 2, where the gas separates and rises to become annular gas 4 to continue the cycle. The liquids 17 separate from the commingled fluids 18 and fall by the force of gravity and are trapped in annulus 2 above packer 14 and are prevented from flowing back into perforated sub 24 because of standing valve 28. As liquids 17 accumulate in annulus 2, they rise above pump 5 and are forced by gravity to enter inside of gas shroud 58 and into perforated tubular member 57 where they travel up cross-over sub 59 to enter pump 5 where they become pumped liquids 13 and are pumped up tubing 3 to the surface 12.

Figure 6:
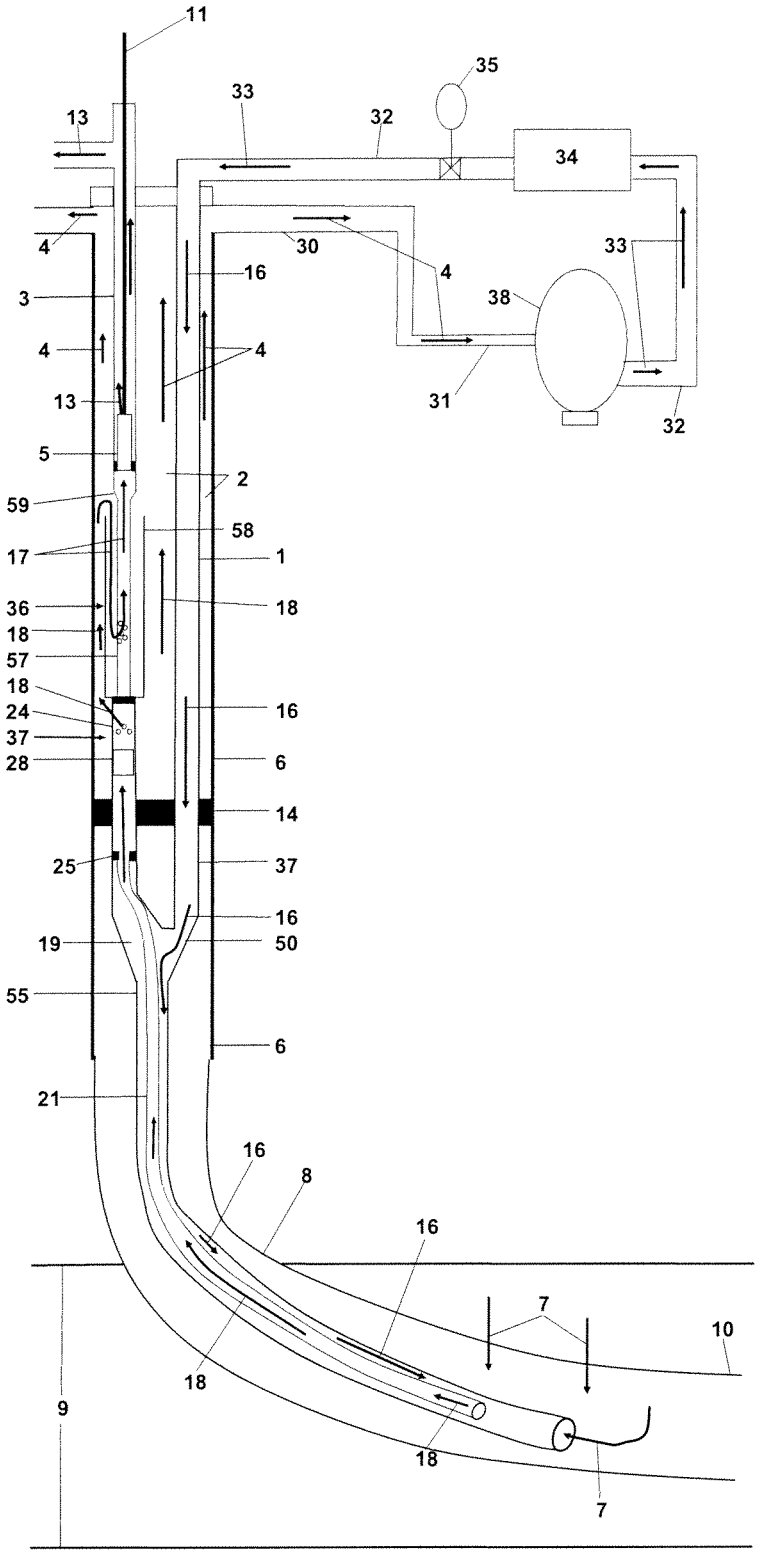
FIG. 6 depicts another embodiment of the invention similar to FIG. 5 except with no internal gas lift valve.

FIG. 6 shows an alternate embodiment of the invention similar to the design in FIG. 5 except that it does not utilize the internal gas lift valve 15.

Figure 7:
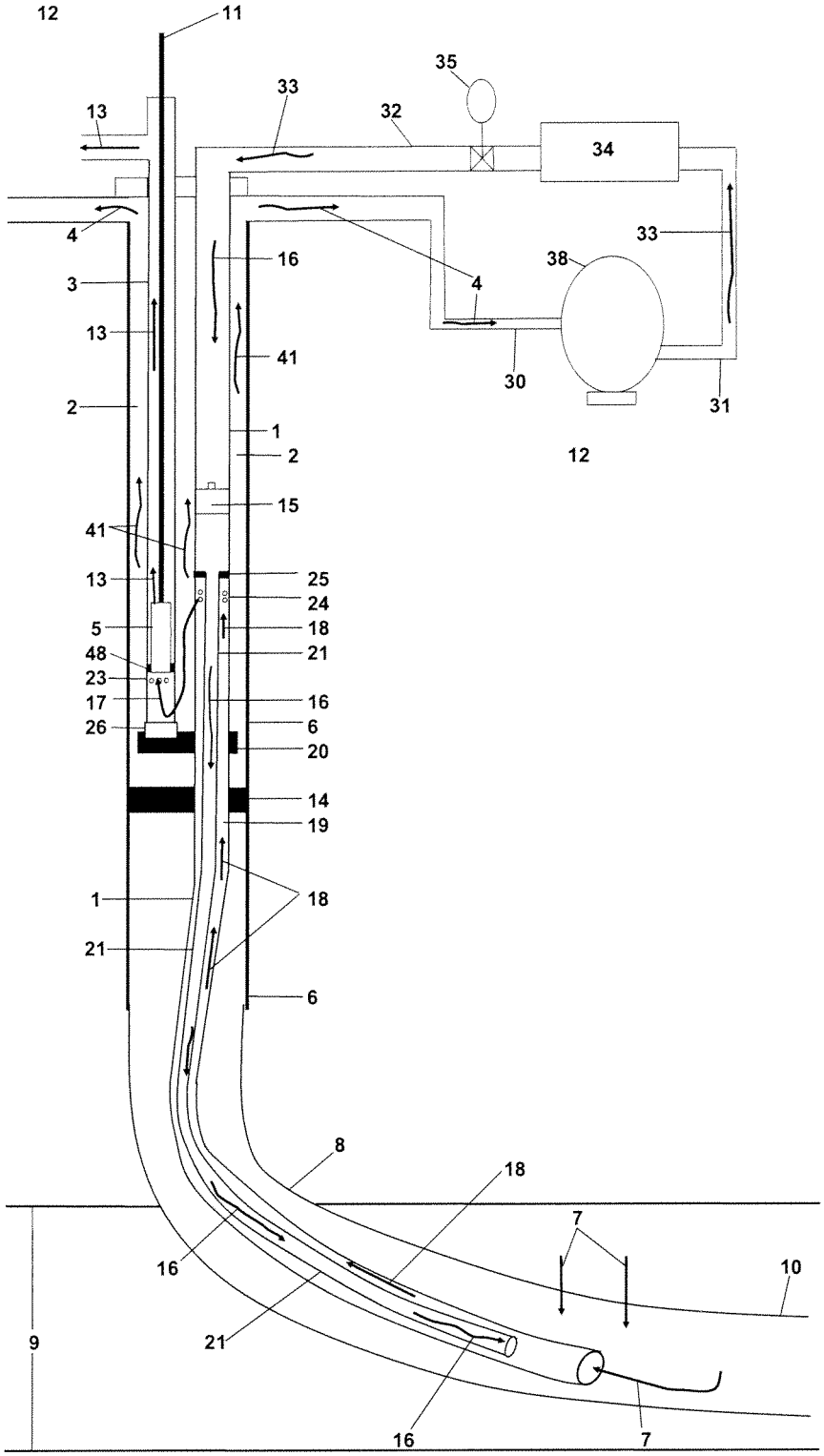
FIG. 7 depicts another embodiment similar to FIG. 3, except with a dual string anchor and an on-off tool.

FIG. 7 shows an alternate embodiment similar to FIG. 3, except that there is a downhole anchor assembly or dual string anchor 20 disposed with first tubing string 1 and installed and attached with second tubing string with on-off tool 26. Referring to FIG. 7, first tubing string 1 is inside casing 6. First tubing string 1 begins at the surface 12 and contains internal gas lift valve 15, bushing 25, perforated sub 24, and inner tubing 21. Perforated sub 24 is available from Weatherford International of Houston, Tex., among others. Tubing 1 is engaged to dual string anchor 20 and continues through it and is engaged to packer 14 and extends through it. Inner tubing 21 connects to bushing 25 and continues through perforated sub 24, dual string anchor 20, packer 14 and terminates prior to the end of tubing 1. Dual string anchor 20 is available from Kline Oil Tools of Tulsa, Okla., among others. Other types of dual string anchors 20 are also contemplated. Inner tubing 21 may be within tubing 1. Tubing 1 extends through and below dual string anchor 20 and through and below packer 14 through curve 8 and into lateral 10, which is drilled through reservoir 9. Second tubing string 3 is inside casing 6 and adjacent to first tubing string 1. Second tubing string 3 contains perforated sub 23, sucker rods 11, pump 5, seating nipple 48, and on-off tool 26. Second tubing string 3 may be selectively engaged to dual string anchor 20 with on-off tool 26. On-off tool 26 is available from D&L Oil Tools of Tulsa, Okla. and from Weatherford International of Houston, Tex., among others. Other types of on-off tool 26 and attachment means are also contemplated. On-off tool 26 may be disposed with perforated sub 23, which may be attached with second tubing string 3.

The process for FIG. 7 is similar to that for FIG. 3. The dual string anchor 20 functions to immobilize the second tubing string 3 by supporting it with first tubing string 1. Immobilization is important, since in deeper pump applications, the mechanical pump 5 may induce movement to second tubing string 3 which may in turn cause we on the tubulars. Movement may also cause the mechanical pump operation to cease or become inefficient. On-off tool 26 allows the second tubing string 3 to be selectively connected or disconnected from the dual string anchor 20 without disturbing the first tubing string 1. The dual string anchor 20 minimizes inefficiencies in the pump and costly workovers to repair wear on the tubing strings. This movement is caused by the movement induced upon the second tubing string by the downhole pumping system.

Figure 8:
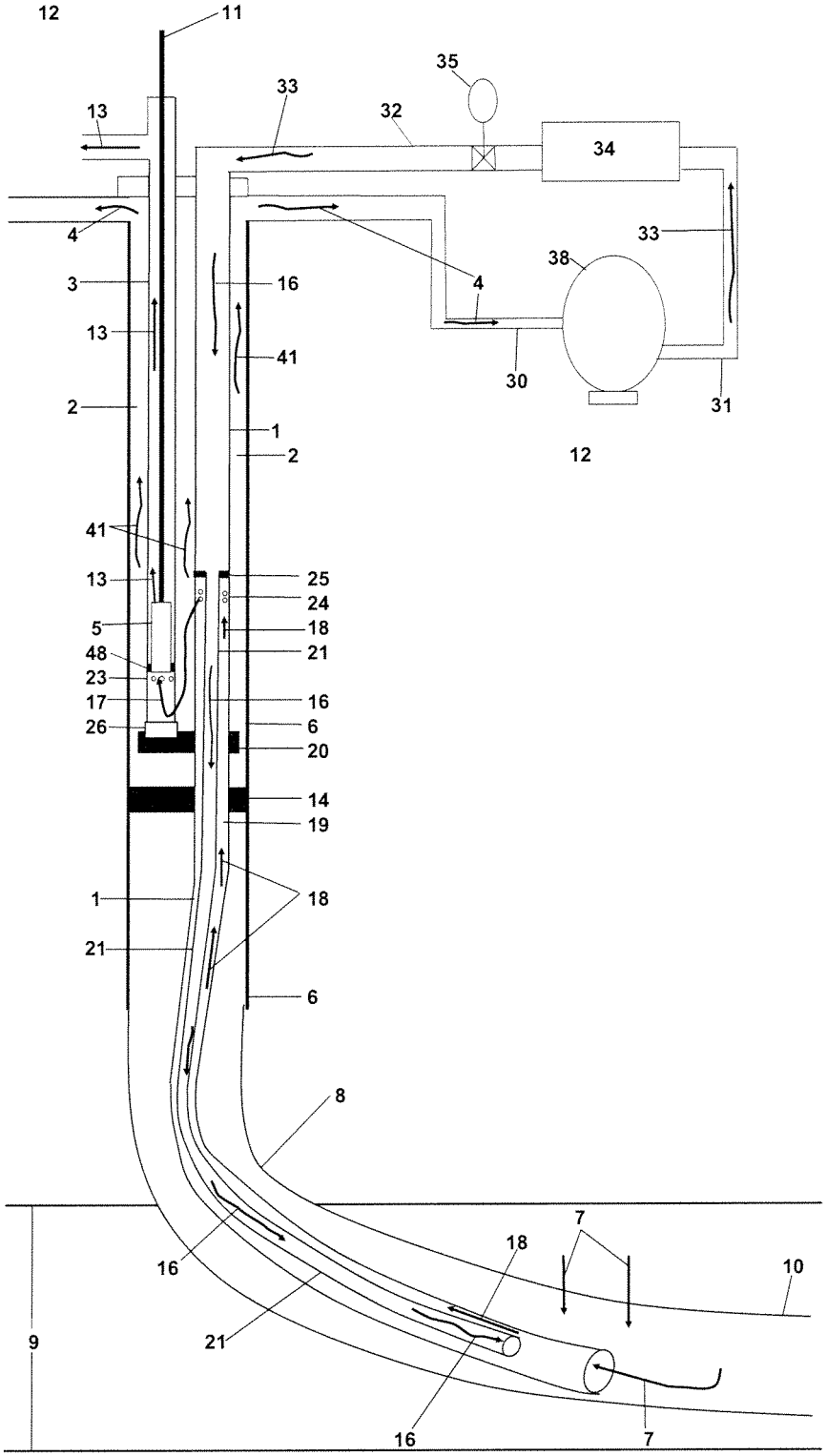
FIG. 8 depicts another embodiment similar to FIG. 7, except with no internal gas lift valve.

FIG. 8 shows another alternate embodiment similar to the design in FIG. 7 except that it does not utilize internal gas lift valve 15.

Figure 9:
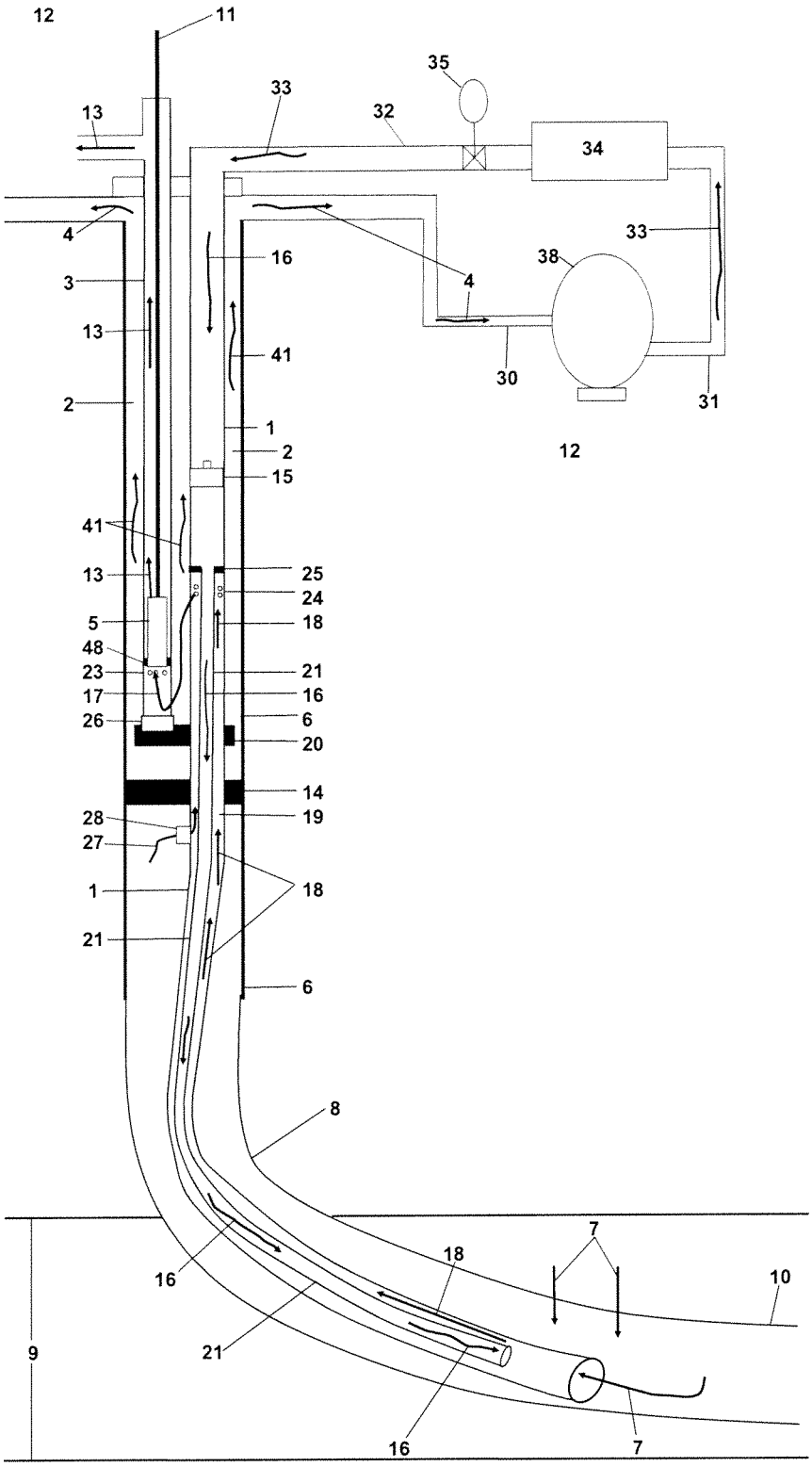
FIG. 9 depicts another embodiment similar to FIG. 7, except with a one-way valve.

FIG. 9 shows another alternate embodiment similar to the design of FIG. 7, except that FIG. 9 includes one-way valve 28 disposed on first tubing string 1 below packer 14. Referring to FIG. 9, when pressure conditions are favorable, one-way valve 28 opens to allow reservoir gas 27 to pass into chamber annulus 19. One-way valve 28 may be a reverse flow check valve available from Weatherford International of Houston, Tex., among others. Other types of one-way valves 28 are also contemplated. Although only one one-valve 28 is shown, it is contemplated that there may be more than one one-way valve 28 for all embodiments. One-way valve 28 may be threadingly disposed with a carrier such as a conventional tubing retrievable mandrel or a gas lift mandrel. Other connection types, carriers, and mandrels are also contemplated.

One-way valve 28 functions to allow fluids to flow from outside to inside the device in one direction only. In FIGS. 9-14, one-way valve 28 may be placed in the first tubing string 1 below the packer 14 to vent trapped pressure below the packer 14 into the first tubing string 1. In a vertical well application, this venting may assist the optimum functioning of the artificial lift system. One-way valve 28 has at least two functions: (1) it provides a pathway to the surface for reservoir gas 27 trapped below packer 14, and (2) it leads to production increases by reducing back pressure on the reservoir. As can now be understood, one-way valve 28 may be positioned at a location on first tubing string 1, such as below packer 14, that is different than the location where injected gas 16 initially commingles with the reservoir fluids where inner tubing 21 ends. Injected gas 16 may initially commingle with reservoir fluids 7 at a first location, and one-way valve 28 may be disposed on first tubing string 1 at a second location. One-way valve 28 may be disposed above reservoir 9, although other locations are contemplated. One-way valve 28 allows the venting of trapped fluids, and allows flow in only one direction.

Figure 10:
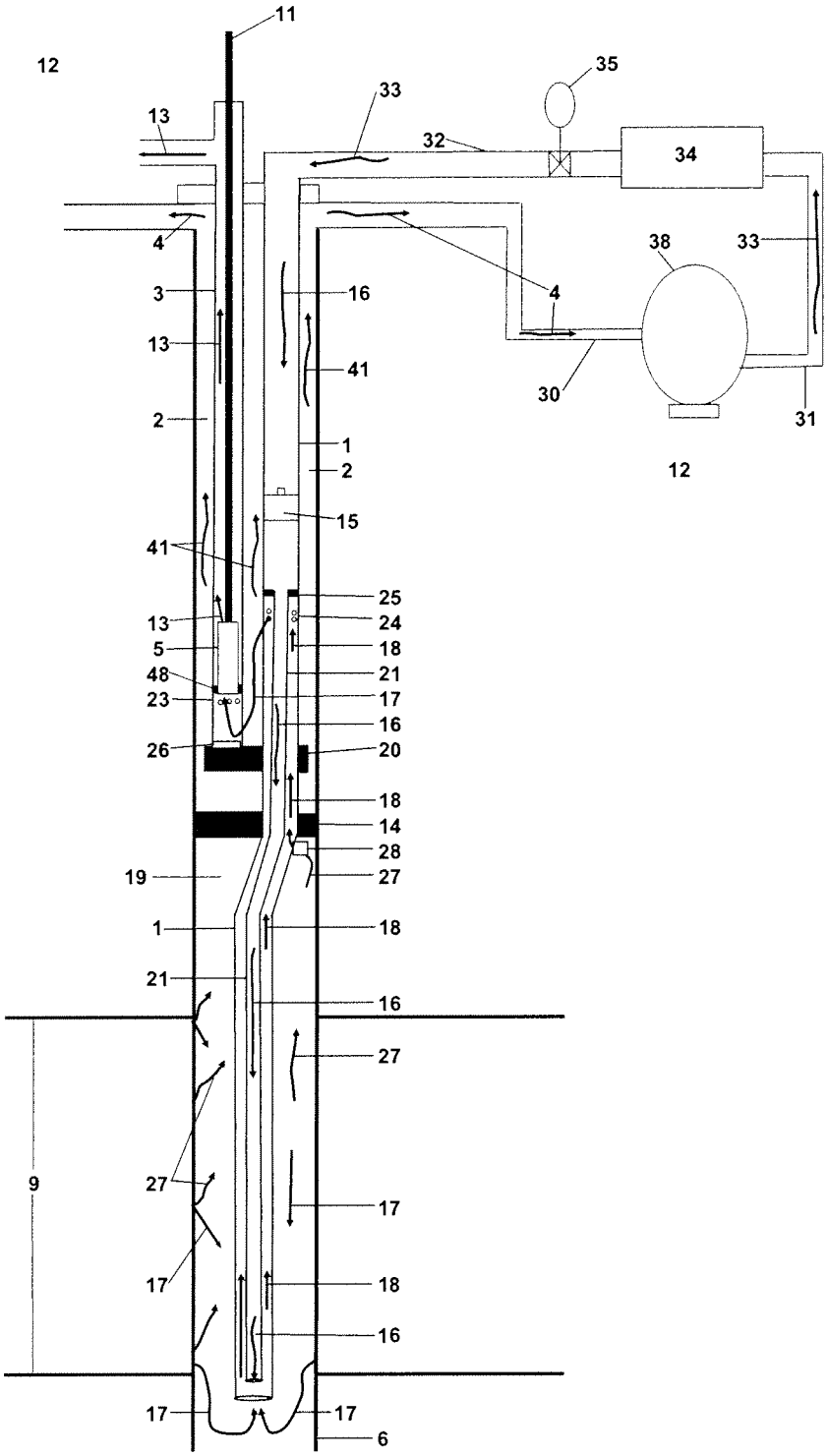
FIG. 10 is the embodiment of FIG. 9, except shown in a completely vertical wellbore.

FIG. 10 shows the embodiment of FIG. 9 in a completely vertical wellbore.

As can now be understood, dual string anchor or dual tubing anchor 20 with on-off tool 26 and one way-valve 28 may be used independently, together, or not at all. For all embodiments in deviated, horizontal, or vertical wellbore applications, there may be (1) gas lift valve 15, dual string anchor 20, and one-way valve 28 below packer 14, (2) no gas lift valve 15, no dual string anchor 20, and no one-way valve 28 below packer 14, or (3) any combination or permutation of the above. Surface tank 34 and actuated valve 35 are also optional in all the embodiments.

Figure 11:
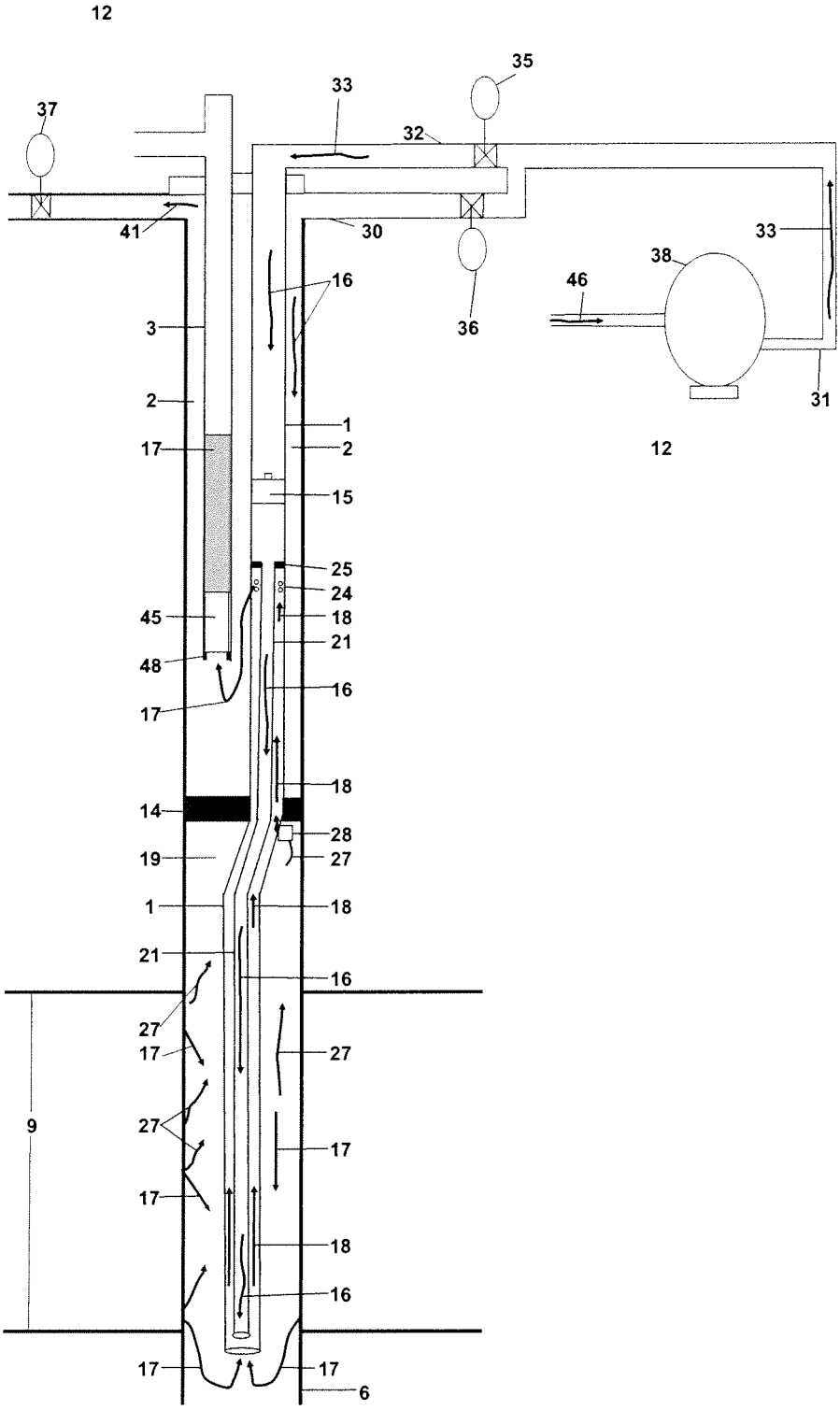
FIG. 11 is an embodiment similar to FIG. 11, except that an alternative embodiment plunger lift system is installed in place of the downhole pump system, and with no surface tank and no dual string anchor.

FIG. 11 is an embodiment similar to FIG. 10 in which pump 5 and sucker rods 11 have been replaced with an alternative embodiment plunger lift system, and there is no surface tank 34 and no one-way valve 28. Referring to FIG. 11, the process is as follows. Initially, actuated valve 37 is open at surface 12, which allows flow from tubing 3 to surface 12. Actuated valve 35 is open and actuated valve 36 is closed. Supply gas 46, which may emanate from the well or a pipeline, is compressed by compressor 38 and compressed gas 33 flows through flow line 31, through actuated valve 35 and flow line 32, and into tubing 1 to become injection gas 16, which then flows down tubing 1, through gas lift valve 15, and through inner tubing 21. At the end of inner tubing 21, injection gas 16 combines with reservoir fluids 7 to become commingled fluids 18, which rise up chamber annulus 19 and flow through perforated sub 24 into annulus 2. Liquids 17 fall to the bottom of annulus 2.

As more liquids are added in annulus 2, they eventually rise above plunger 5 and into tubing 3 and rise above perforated sub 24, which may cause the injection pressure to rise which signals actuated valve 35 to close, actuated valve 39 to open, and actuated valve 37 to close. Compressed gas 33 then flows through actuated valve 36 and through flow line 30, and into annulus 2 to become injection gas 16. When a sufficient volume of injection gas 16 has been added to annulus 2, the pressure in annulus 2 rises sufficiently to signal actuated valve 37 to open, actuated valve 36 to close, and actuated valve 35 to open. The pressure differential lifts plunger 45 off of seating nipple 48 and rises up tubing 3 and pushes liquids 17 to surface 12. Some injection gas 16 also flows to surface 12 via tubing 3. Once the pressure on tubing 3 drops sufficiently, plunger 45 falls back down to seating nipple 48 and the process begins again. Other sequences of the timing of the opening and closing of the actuated valves are contemplated. Surface tank 34 may also be utilized.

Figure 12:
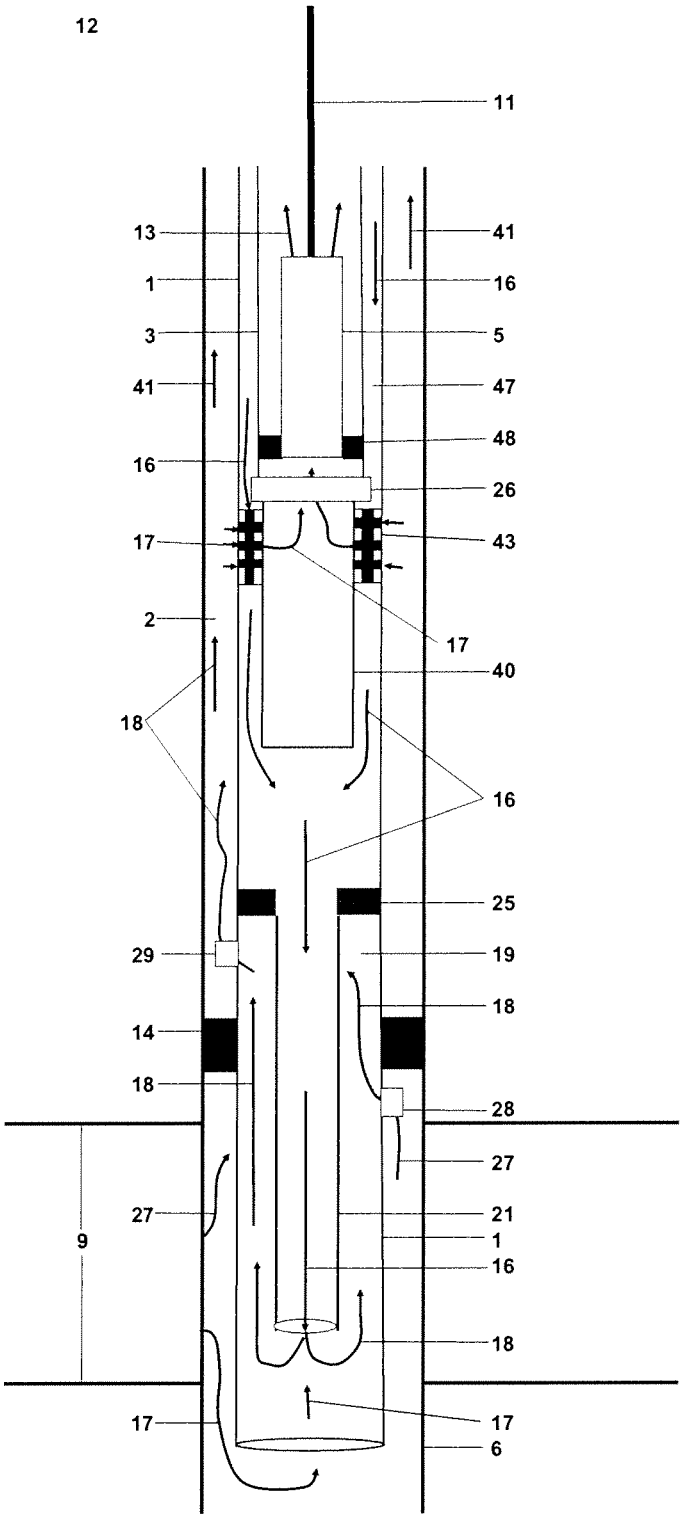
FIG. 12 depicts another embodiment in a vertical wellbore utilizing a bi-flow connector.
Figure 13:
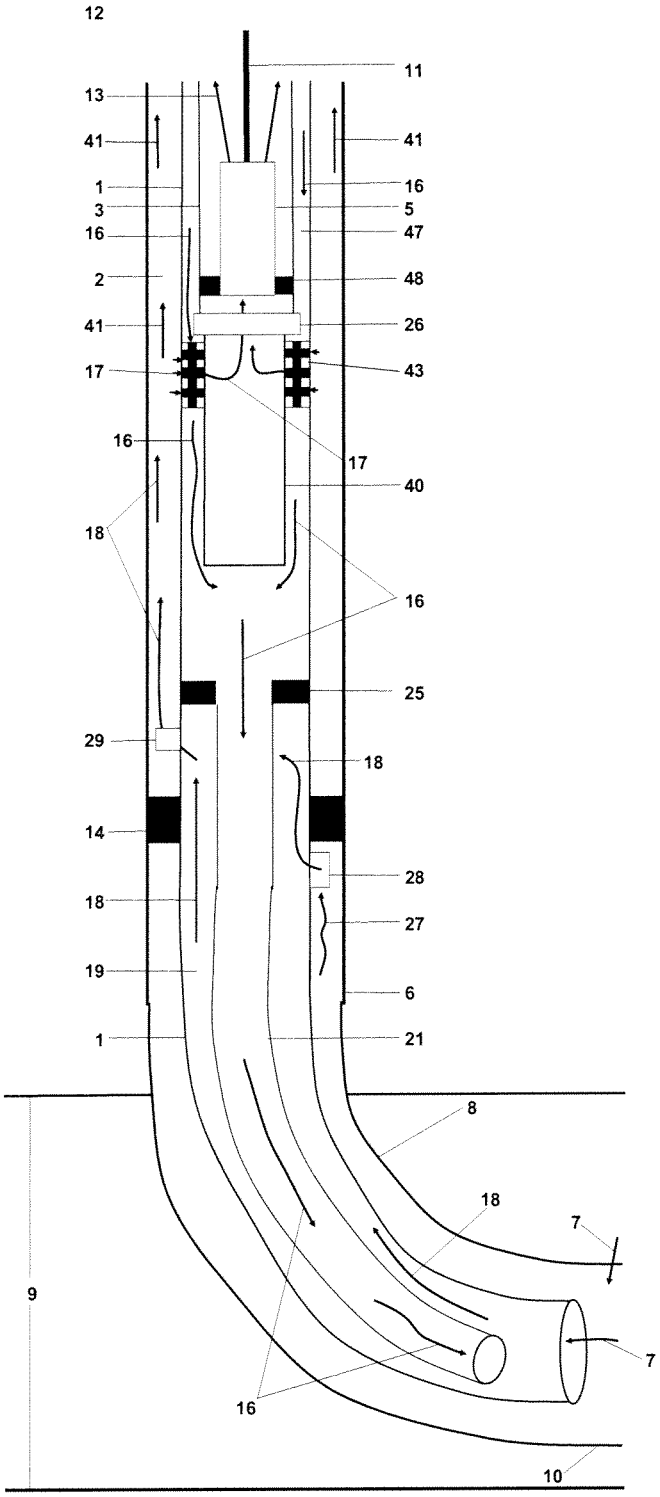
FIG. 13 is the embodiment of FIG. 12 except in a horizontal wellbore.
Figure 13A:
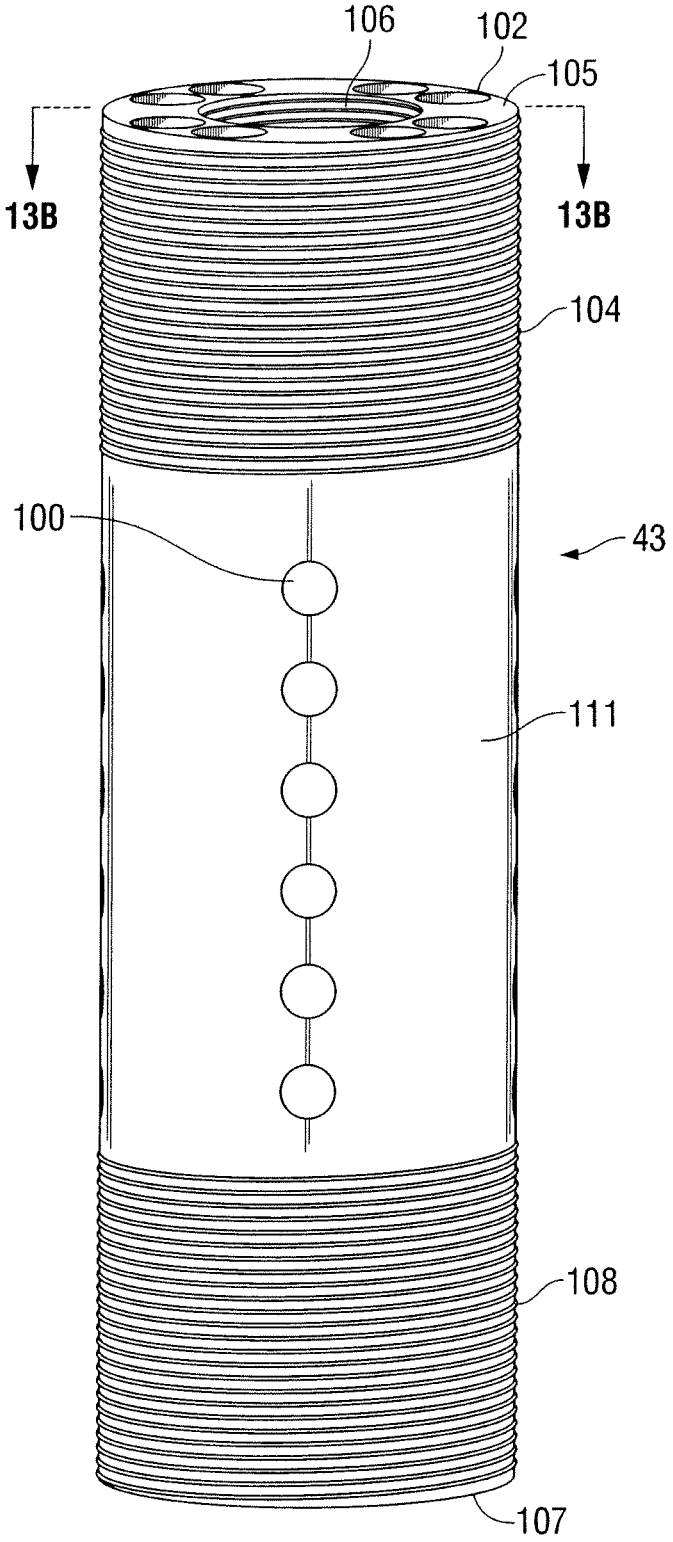
FIG. 13A is an isometric view of a bi-flow connector.
Figure 13B:
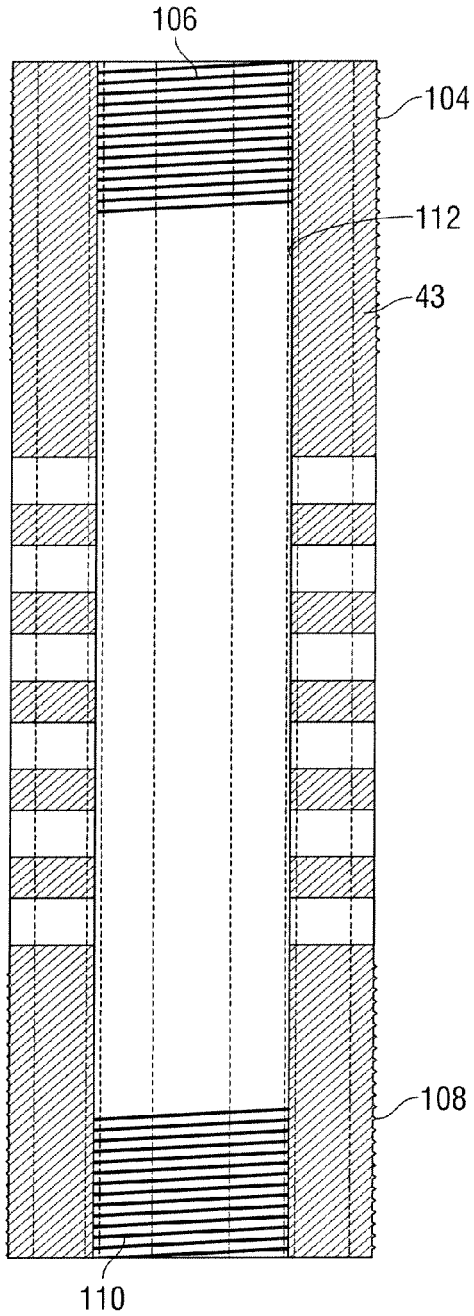
FIG. 13B is a section view along line 13A-13A of FIG. 13.
Figure 13C:
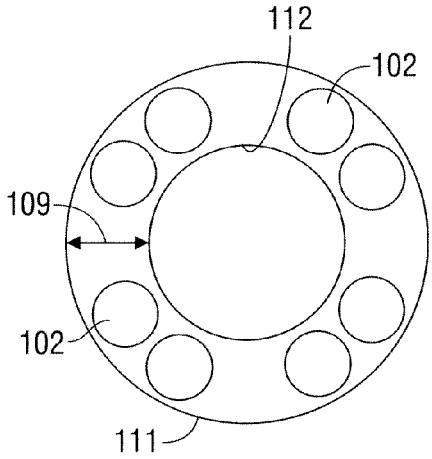
FIG. 13C is a top view of FIG. 13A.

FIG. 12 is another embodiment and utilizes an outer and inner tubing arrangement, such as concentric, incorporating a novel bi-flow connector 43 in a vertical wellbore. The bi-flow connector 43 is shown in detail in FIGS. 13A-13D and discussed in detail below. FIG. 13 is similar to FIG. 12 except in a horizontal wellbore. Although FIG. 13 is discussed below, the discussion applies equally to FIG. 12. In FIG. 13, first tubing string 1 begins at surface 12 and is installed inside casing 6, contains bi-flow connector 43, bushing 25, one way valve 29, and is sealingly engaged to packer 14. Mud anchor 40 may be connected to bi-flow connector 43 to act as a reservoir for particulates that fall out of liquids 17, and to isolate the injection gas 16 from liquids 17. Mud anchor 40 is a tubing with one end closed and one end open, and is available from Weatherford International of Houston, Tex., among others. First tubing string 1 continues below packer 14 and contains one way valve 28 and continues until it terminates in curve 8 or lateral 10, or for FIG. 12 in or below reservoir 9. Within first tubing string 1 is second tubing string 21, which is also sealingly engaged to bushing 25 and continues down through packer 14 and may terminate prior to the end of first tubing string 1. Third tubing string 3 is within first tubing string, and begins at surface 12 and terminates in on-off tool 26. On-off tool 26 allows third tubing string 3 to be selectively engaged to first tubing string 1. On-off tool 26 is sealingly engaged to bi-flow connector 43. Contained inside first tubing string 3 are sucker rods 11, pump 5 and seating nipple 48. Sucker rods 11 are connected to pump 5 which is selectively engaged into seating nipple 48. Seating nipple 48 is available from Weatherford International of Houston, Tex., among others.

Figure 13D:
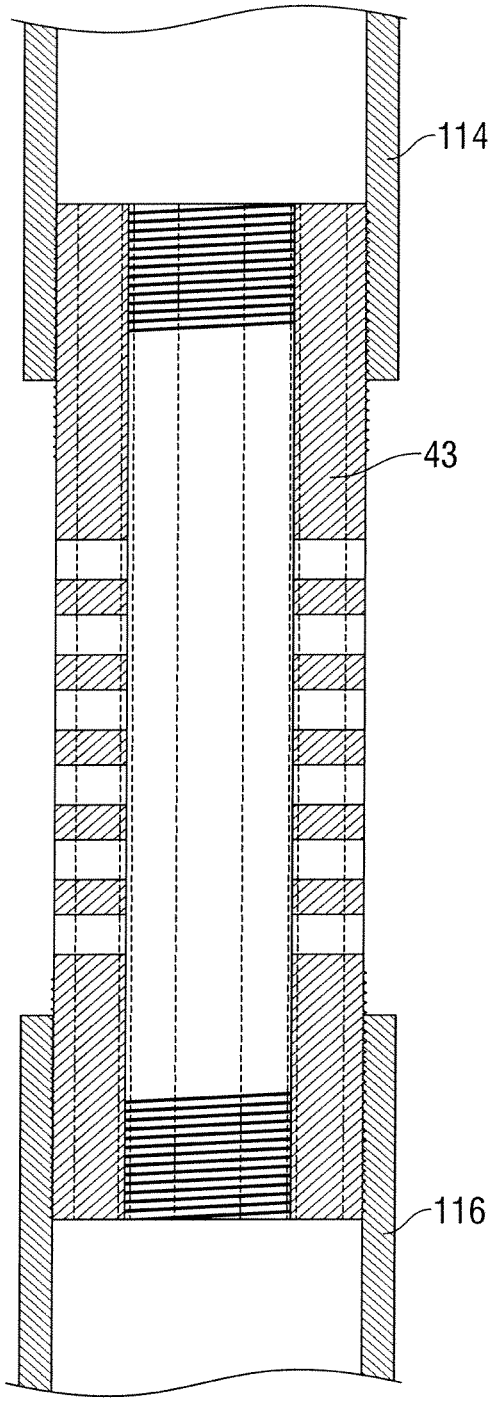
FIG. 13D is a section view similar to FIG. 13B except with the bi-flow connector threadably attached at a first end with a first tubular and at a second end with a second tubular.

As shown in FIGS. 13A-13D, bi-flow connector 43 is a cylindrically shaped body with a central bore 112 extending from a first end 105 to a second end 107 and having a thickness 109. Vertical or first channels 102 pass through the thickness 109 of the bi-flow connector 43 from the first end 105 to the second end 107. Horizontal or second channels 100 pass from the side surface 111 through the thickness 109 of the bi-flow connector 43 to the central bore 112. Although shown vertical and horizontal, it is also contemplated that first channels may not be vertical and second channels may not be horizontal. Different numbers and orientations of channels are contemplated. The first channels 102 and second channels 100 do not intersect. Threads 104, 108 are on the side surface 111 of the bi-flow connector 43 adjacent its first and second ends 105, 107. There may also be inner threads 106, 110 on the inner surface of the central bore 112 adjacent the first and second ends. As shown in FIGS. 12-13, the mud anchor 40 is attached with the inner threads 110, and the first tubing string 1 is attached with the outer threads 104, 108. In FIG. 13D, the threaded connection between the bi-flow connector 43 between upper tubular 114 and lower tubular 116 is similar to the connection in FIG. 13 between the bi-flow connector 43 and first tubing string 1.

Returning to FIG. 13, the process may be as follows. Injection gas 16 travels down annulus 47 and passes vertically through bi-flow connector 43 and continues down through bushing 25, packer 14, second tubing string 21 and out into first tubing string 1 where it commingles with reservoir fluids 7 to become commingled fluids 18. Reservoir gas emanates from reservoir 9 and may travel through one way valve 28 and become part of commingled fluids 18, which rise up annulus 19 and travel through one way valve 29 and then separate into liquids 17 and commingled gas 41. Liquids 17 may enter horizontally through bi-flow connector 43 and up to pump 5 where they become pumped liquids 13 and are pumped to surface 12. Commingled gas 41 rises up annulus 2 to surface 12.

As can now be understood, the bi-flow connector 43 allows downward injection gas to pass vertically through the tool, while simultaneously allowing reservoir liquids to pass horizontally through the tool, without commingling the reservoir liquids with the downwardly flowing injection gas. The bi-flow connector 43 also allows the inner tubing string, such as third tubing string 3, to be selectively engaged to the outer tubing string, such as first tubing string 1. The bi-flow connector 43 may be used in small casing diameter wellbores in which the installation of two side by side or adjacent tubing strings is impractical or impossible. The bi-flow connector 43 is advantageous to wells that have a smaller diameter casing. Other non-concentric tubing arrangement embodiments may require larger casing sizes. A plunger system is also contemplated in place of the downhole pump.

Figure 14:
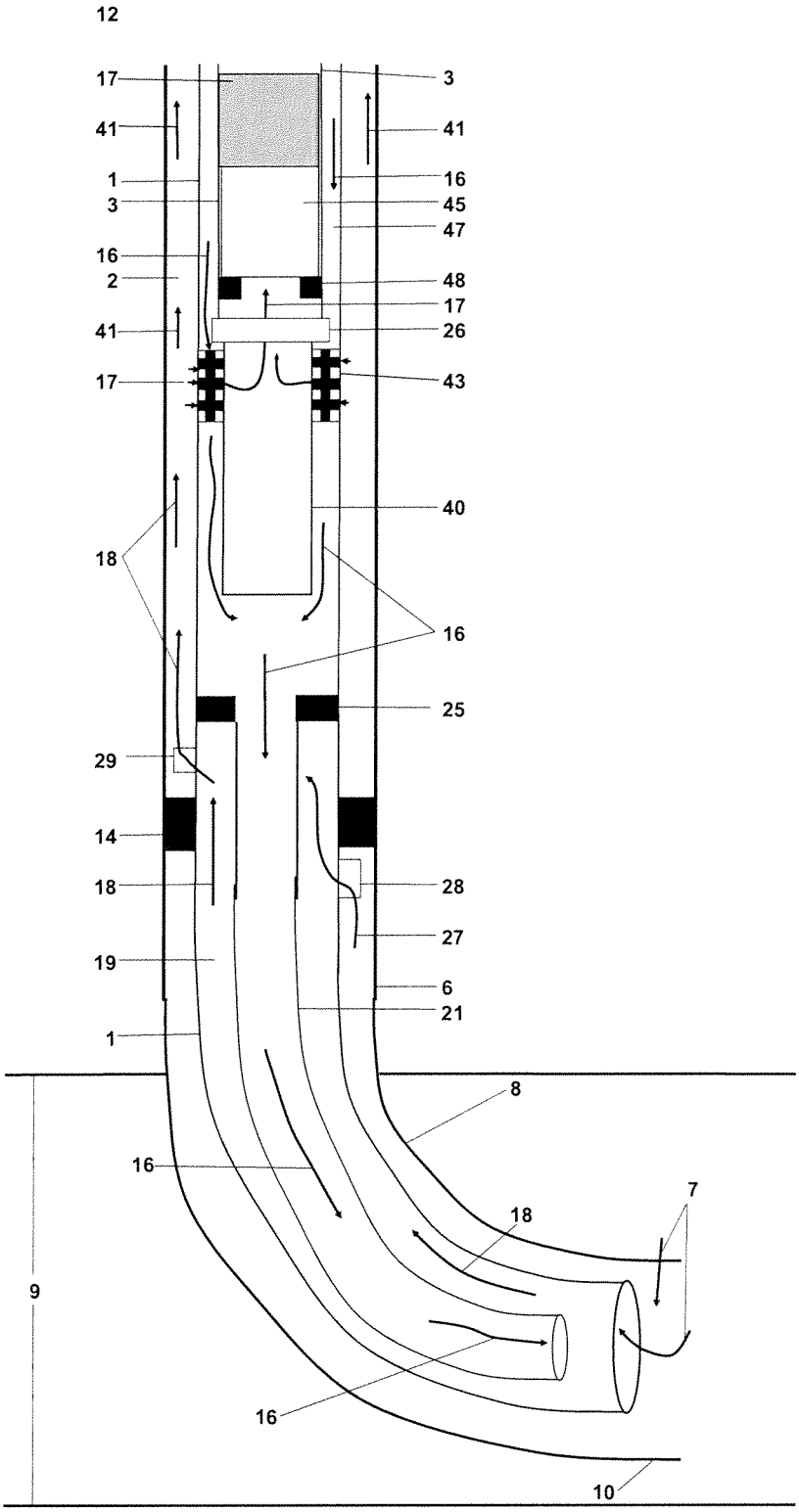
FIG. 14 is the embodiment of FIG. 13 except that an alternative embodiment plunger lift system is installed in place of the downhole pump system.

FIG. 14 is the same embodiment as FIG. 13 except that an alternative embodiment plunger lift system is installed in place of the downhole pump system. A pump and a plunger are both fluid displacement devices.

Figure 15:
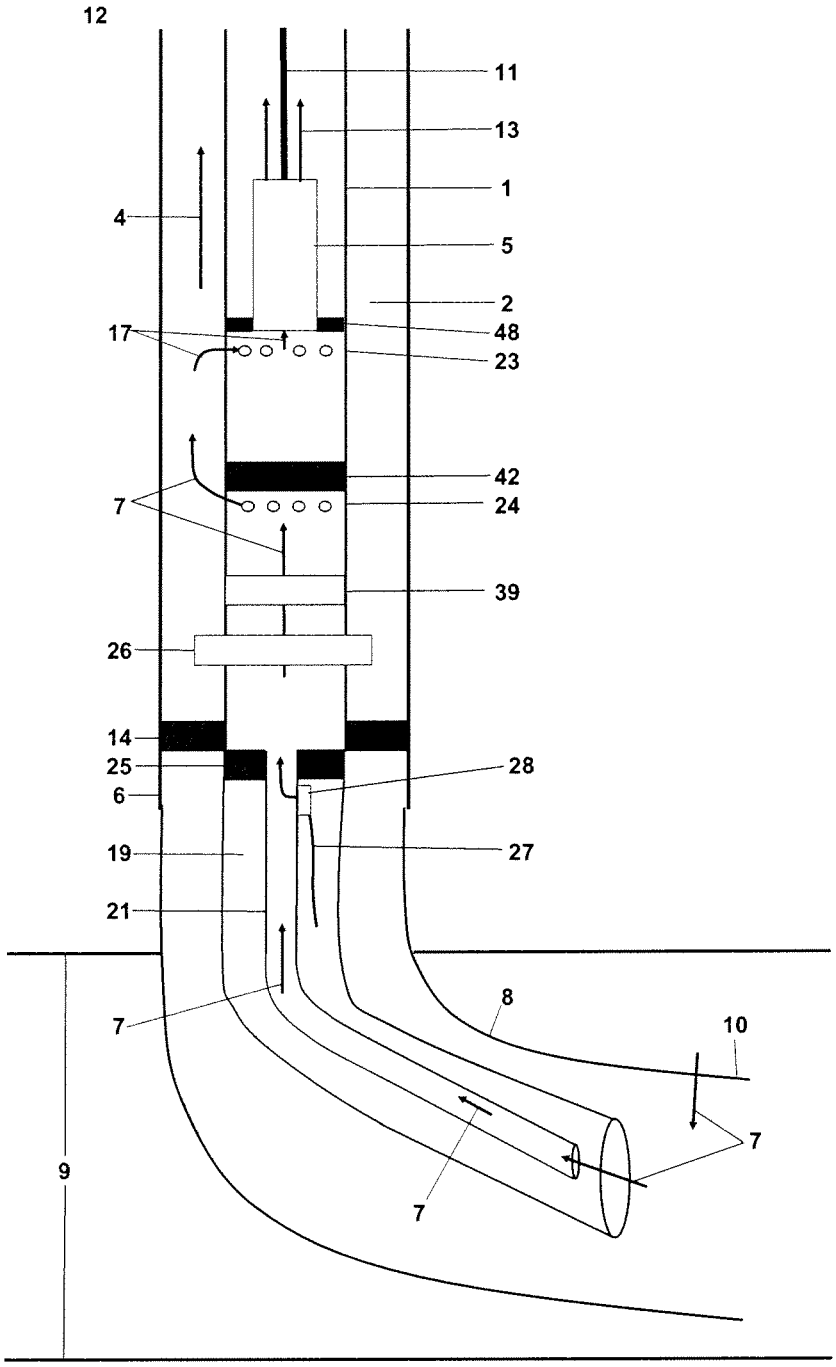
FIG. 15 depicts another embodiment that utilizes gas that emanates from the reservoir to lift liquids from the curved or horizontal section of the wellbore.

FIG. 15 is another embodiment using only reservoir gas to lift the reservoir liquids from below the downhole pump to above the downhole pump. This embodiment is similar to FIG. 13, but no inner tubing, such as third tubing string 3, is needed to house the downhole pump and no external injection gas is needed. It may also incorporate a one way valve 28 in the tubing string to prevent wellbore liquids from falling back down the wellbore. The one way valve 28 allows the liquids to be trapped above the packer until the pump can lift them to the surface. The smaller diameter of the inner tubing efficiently lifts reservoir fluids by forcing the reservoir gas into a smaller cross-sectional area whereby the gas is not allowed to rise faster than the reservoir liquids. Due to the smaller tubing size, a relatively small amount of reservoir gas can lift reservoir liquids the relatively short distance from the end of the tubing to the one way valve.

Referring to FIG. 15, first tubing string 1 begins at surface 12 and contains seating nipple 48, upper perforated sub 23, blank sub 42, lower perforated sub 24, one way valve 39, on-off tool 26, packer 14, bushing 25 and terminates in curve 8 or lateral 10. Seating nipple 48, blank sub 42, perforated subs 23, 24, on-off tool 26, packer 14, one way valve 39, and bushing 25 are all available from Weatherford International of Houston, Tex., among others. Connected to seating nipple 48 is pump 5 which is connected to sucker rods 11 which continue up to surface 12. Connected to bushing 25 is second tubing string 21 which is connected to one way valve 28, and continues down the wellbore and may terminate prior to the end of tubing 1.

The process may be as follows. Reservoir fluids 7 emanate from reservoir 9 and enter lateral 10 and then enter first tubing string 1 and second tubing string 21. Gas in reservoir fluids 7 expand inside second tubing string 21 and lift reservoir fluids 7 up and out of second tubing string 21 into first tubing string 1, through on-off tool 26, through one way valve 39 and out of lower perforated sub 24 and into annulus 2. Reservoir fluids 7 separate into liquids 17 and annular gas 4. Liquids 17 enter into upper perforated sub 23 and then enter into pump 5 where they become pumped liquids 13 and are pumped to surface 12 via tubing 1. Annular gas 4 rises up annulus 2 to surface 12.

Figure 16:
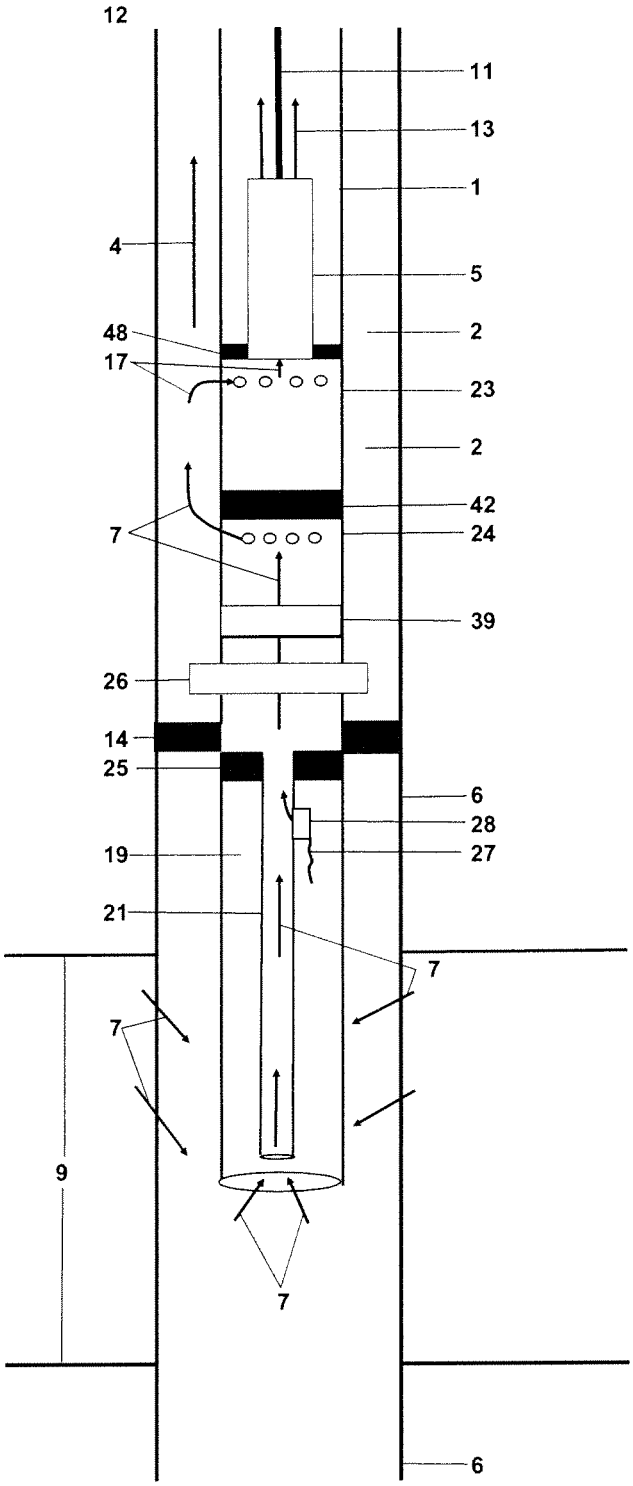
FIG. 16 is the embodiment of FIG. 15 except it is shown in a vertical wellbore.

FIG. 16 is the embodiment of FIG. 15 except in a vertical wellbore.

Figure 17:
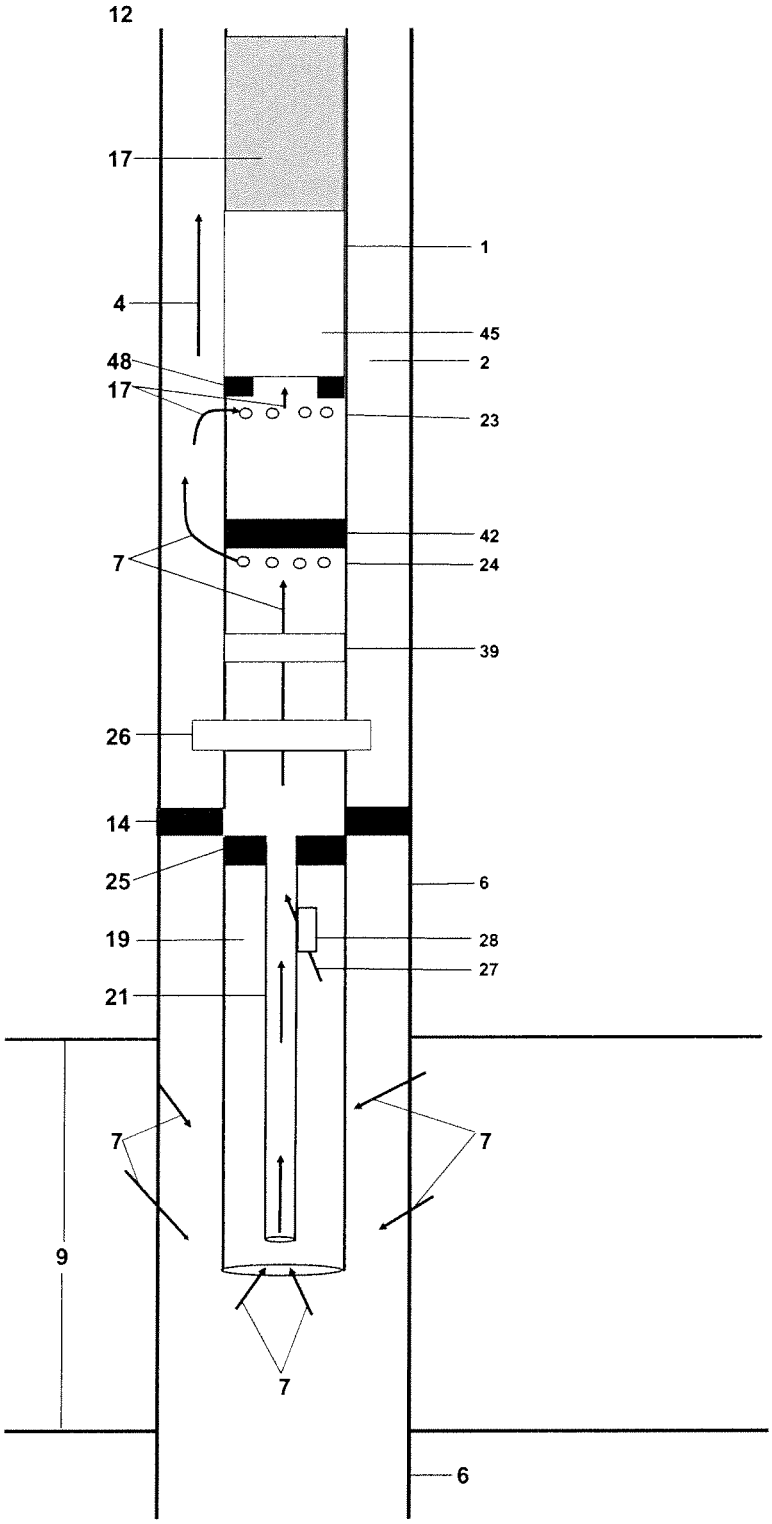
FIG. 17 is the embodiment of FIG. 16 except that an alternative embodiment plunger lift system is installed in place of the downhole pump system.

FIG. 17 is the embodiment of FIG. 16 except that a plunger has been installed in place of the sucker rods and pump. The plunger may be operated merely by the periodic opening and closing of the first tubing string 1 to the surface or it may be operated by the periodic or continuous injection of gas down the annulus combined with the periodic opening and closing of the first tubing string 1 to the surface. Both methods will force the plunger and liquids above it to the surface. This embodiment is much less expensive than installing a downhole pump. This design is advantageous for wells that have sufficient reservoir energy and gas production to lift liquids from below the downhole pump to above the downhole pump, yet still require artificial lift equipment to lift these liquids to the surface. This embodiment is less costly to install since no injection gas from the surface is required. Subsequently there is no gas injection tubing, no surface tank, no actuated valve, no compressor, and no dual string anchor. It will also accommodate wellbores with smaller casing diameters.

The embodiment of FIGS. 15-16 is advantageous for wells that have sufficient reservoir energy and gas production to lift liquids from below the downhole pump to above the downhole pump, yet still require artificial lift equipment to lift these liquids to the surface. This embodiment is less costly to install since no injection gas from the surface is required. There does not have to be any gas injection tubing, surface tank, actuated valve, compressor, or dual string anchor. It will also accommodate wellbores with smaller casing diameters. The embodiment of FIG. 17 is even less expensive because there does not have to be any downhole pump and related equipment.

An advantages of all embodiments is a lower artificial lift point and better recovery of hydrocarbons. There is better gas and particulate separation in all embodiments. In FIGS. 3-11, the entry point for the commingled fluids is above the intake of the pump or other fluid displacement device, which helps break out any gas in the fluids since gravity will segregate the gas from the liquids. The same is true for particulates since there is a large reservoir for them to collect in below the pump. In FIGS. 12-17, the gas is discouraged from entering the perforated subs because of gravity separation.

Because many varying and different embodiments may be made within the scope of the invention concept taught herein which may involve many modifications in the embodiments herein detailed in accordance with the descriptive requirements of the law, it is to be understood that the details herein are to be interpreted as illustrative and not in a limiting sense.

I claim:

1. An artificial lift system in a wellbore extending from the surface to a reservoir having reservoir fluids, comprising:

a casing in the wellbore;

a first tubing string sealingly engaged with and extending through a packer disposed in said casing;

a bi-flow connector attached in said first tubing string above the packer;

a second tubing string disposed in a portion of said first tubing string below said bi-flow connector; and a third tubing string disposed in a portion of said first tubing string above said bi-flow connector and containing a fluid displacement device configured to move reservoir fluids to the surface;

wherein said first tubing string is configured to transport a pressured gas downwardly from the surface through said bi-flow connector to commingle with and lift the reservoir fluids through an annulus between said casing and said first tubing string;

wherein an end of said third tubing string is connected with said bi-flow connector; and wherein said bi-flow connector is configured to allow both the downward pressured gas and the lifted reservoir fluids to simultaneously pass through said bi-flow connector without contacting each other.

2. The artificial lift system of claim 1, wherein said displacement device is a pump.

3. The artificial lift system of claim 1, wherein said displacement device is a plunger.

4. The artificial lift system of claim 1, further comprising a first one-way valve attached in said first tubing string above said packer.

5. The artificial lift system of claim 4, further comprising a second one-way valve attached in said first tubing string below said packer.

6. The artificial lift system of claim 1, wherein said bi-flow connector comprises a cylindrical body having a thickness, a first end, a second end, a central bore from said first end to said second end, a side surface, a first channel disposed through said thickness from said first end to said second end, and a second channel disposed through said thickness from said side surface to said central bore; and wherein said first channel and said second channel do not intersect.

7. The artificial lift system of claim 6, wherein there is more than one channel disposed through said thickness from said first end to said second end; and wherein there is more than one channel disposed through said thickness from said side surface to said central bore.

8. The artificial lift system of claim 1, wherein said third tubing string is connected with said bi-flow connector with an on-off tool and a mud anchor.

9. The artificial lift system of claim 8, wherein the mud anchor is disposed below said bi-flow connector.

10. The artificial lift system of claim 8, wherein said mud anchor comprises a tubular with a first end open and a second end closed.

11. The artificial lift system of claim 1, wherein an end of said second tubing string is connected in said first tubing string with a bushing above said packer.

12. The artificial lift system of claim 1, wherein the third tubing string and the first tubing string extend substantially to the surface.

13. The artificial lift system of claim 1, wherein the fluid displacement device is positioned to allow pumping of reservoir fluids to the surface when an injection pressure of the pressured gas is below a lift pressure required to lift the reservoir fluids to the surface.

14. The artificial lift system of claim 1, wherein the reservoir fluids are also lifted through an annulus defined by the first tubing string and the second tubing string.

15. A method for producing reservoir fluids with an artificial lift system from a wellbore extending from the surface to a reservoir, comprising:

positioning a first tubing string through a packer disposed in a casing in the wellbore;

injecting a pressured gas from the surface in said first tubing string downwardly through a bi-flow connector attached with said first tubing string;

moving the pressured gas downwardly through a second tubing string attached with said first tubing string above said packer;

commingling the pressured gas with the reservoir fluids;

lifting the commingled pressured gas and reservoir fluids through an annulus between the casing and the first tubing string;

moving the lifted reservoir fluids through said bi-flow connector during the step of injecting the pressured gas downwardly through said bi-flow connector without contacting the lifted reservoir fluids with the downward pressured gas; and displacing said reservoir fluids to the surface with a displacement device disposed in a third tubing string positioned in said first tubing string above said bi-flow connector.

16. The method of claim 15, wherein said displacement device is a pump.

17. The method of claim 15, wherein said displacement device is a plunger.

18. The method of claim 15, further comprising the step of:

moving the comingled pressured gas and reservoir fluids through a first one-way valve attached in said first tubing string above said packer.

19. The method of claim 18, further comprising the step of:

moving the comingled pressured gas and reservoir fluids through a second one-way valve attached in said first tubing string below said packer.

20. The method of claim 15, wherein said bi-flow connector comprises a cylindrical body having a thickness, a first end, a second end, a central bore from said first end to said second end, a side surface, a first channel disposed through said thickness from said first end to said second end, a second channel disposed through said thickness from said side surface to said central bore; and wherein said first channel and said second channel do not intersect.

21. The artificial lift system of claim 20, wherein there is more than one channel disposed through said thickness from said first end to said second end; and wherein there is more than one channel disposed through said thickness from said side surface to said central bore.

22. The method of claim 15, further comprising the step of lifting the commingled pressured gas and reservoir fluids through an annulus defined by the first tubing string and the second tubing string.

23. A method for moving reservoir fluids in a wellbore to the surface, comprising the steps of:

positioning a cylindrical body in the wellbore; wherein said cylindrical body having a thickness, a first end, a second end, a central bore from said first end to said second end, a side surface, a first plurality of channels disposed through said thickness from said first end to said second end, a second plurality of channels disposed through said thickness from side surface to said central bore; and wherein said first plurality of channels and said second plurality of channels do not intersect;

moving a pressured gas downwardly from the surface through said first plurality of channels; and moving the reservoir fluids through said second plurality of channels.

* * * * *